US006597323B2

(12) United States Patent
Teshirogi et al.

(10) Patent No.: US 6,597,323 B2
(45) Date of Patent: Jul. 22, 2003

(54) DIELECTRIC LEAKY WAVE ANTENNA HAVING MONO-LAYER STRUCTURE

(75) Inventors: Tasuku Teshirogi, Tokyo (JP); Yuki Kawahara, Atsugi (JP); Takashi Hidai, Atsugi (JP); Aya Yamamoto, Kawasaki (JP)

(73) Assignee: Anritsu Corporation, Tokyo (JP)

( * ) Notice: Subject to any disclaimer, the term of this patent is extended or adjusted under 35 U.S.C. 154(b) by 38 days.

(21) Appl. No.: 10/009,396

(22) PCT Filed: Mar. 2, 2001

(86) PCT No.: PCT/JP01/01608

§ 371 (c)(1),
(2), (4) Date: Oct. 22, 2001

(87) PCT Pub. No.: WO01/65640

PCT Pub. Date: Sep. 7, 2001

(65) Prior Publication Data

US 2003/0098815 A1 May 29, 2003

(30) Foreign Application Priority Data

Mar. 3, 2000 (JP) ..... 2000-059006
Jul. 25, 2000 (JP) ..... 2000-224518

(51) Int. Cl.[7] ..... H01Q 13/00

(52) U.S. Cl. ..... 343/786; 343/785; 343/772; 333/21 A

(58) Field of Search ..... 343/769, 770, 343/785, 786, 771, 772, 775, 780

(56) References Cited

U.S. PATENT DOCUMENTS

| | | | | | |
|---|---|---|---|---|---|
| 3,235,869 | A | * | 2/1966 | Atla | 343/755 |
| 4,516,131 | A | * | 5/1985 | Bayha et al. | 343/770 |
| 4,689,629 | A | | 8/1987 | Traut et al. | |
| 4,825,221 | A | | 4/1989 | Suzuki et al. | |
| 4,835,543 | A | | 5/1989 | Sequeira | |
| 5,173,714 | A | | 12/1992 | Arumura et al. | |
| 5,266,961 | A | | 11/1993 | Milroy | |
| 5,416,492 | A | * | 5/1995 | Takahashi et al. | 333/237 |
| 5,642,121 | A | | 6/1997 | Martek et al. | |
| 5,652,596 | A | * | 7/1997 | Abrams et al. | 343/754 |
| 5,757,330 | A | * | 5/1998 | Parfitt | 343/772 |
| 6,040,805 | A | * | 3/2000 | Huynh et al. | 343/785 |
| 6,317,095 | B1 | * | 11/2001 | Teshirogi et al. | 343/770 |

FOREIGN PATENT DOCUMENTS

| | | |
|---|---|---|
| DE | 39 26 187 A1 | 4/1990 |
| JP | 59-89008 A | 5/1984 |
| JP | 64-48503 A | 2/1989 |
| JP | 7-50515 A | 2/1995 |
| JP | 8-125436 A | 5/1996 |
| JP | 10-13138 A | 1/1998 |
| JP | 10-261915 | 9/1998 |
| JP | 11-234036 | 8/1999 |
| WO | WO 91/17586 | 11/1991 |

OTHER PUBLICATIONS

Oliner A.A.: "Recent Developments in Millimeter–Wave Antennas", Alta Frequenza, Ufficio Centrale AEI–CEI, Milano, IT., vol. 58, No. 5/6, Sep. 1, 1989, pp. 55–69.

* cited by examiner

*Primary Examiner*—Tan Ho
(74) *Attorney, Agent, or Firm*—Frishauf, Holtz, Goodman & Chick, P.C.

(57) ABSTRACT

The present invention provides a dielectric leaky-wave antenna having a single-layer structure which is effective for realizing a highly efficient low-cost antenna in a quasi-millimeter wave zone in particular. This dielectric leaky-wave antenna includes a ground plane, a dielectric slab which is laid on one surface of the ground plane and forms a transmission guide for transmitting an electromagnetic wave from one end side to the other end side between itself and the ground plane along the surface, perturbations which are loaded on the surface of the dielectric slab along the electromagnetic wave transmission direction of the transmission guide at predetermined intervals and leak the electromagnetic wave from the surface of the dielectric slab, and a feed which supplies the electromagnetic wave to one end side of the transmission guide.

46 Claims, 12 Drawing Sheets

DIELECTRIC LEAKY WAVE ANTENNA HAVING MONO-LAYER STRUCTURE

This application is a U.S. National Phase Application under 35 USC 371 of International Application PCT/JP01/01608 (not published in English) filed Mar. 2, 2001.

TECHNICAL FIELD

The present invention relates to a dielectric leaky-wave antenna. More particularly, in a dielectric leaky-wave antenna for leaking an electromagnetic wave formed by a ground plane and a dielectric from a transmission guide, the present invention relates to a dielectric leaky-wave antenna having a single-layer structure which adopts a technique for enabling radiation of various kinds of polarized electromagnetic waves by a simple structure.

BACKGROUND ART

In recent years, demands for a planar antenna which can be used in a millimeter wave region for an automotive radar or a wireless LAN have been increasing.

As such an antenna for a millimeter wave region, there have been proposed various kinds of antenna, e.g., one for leaking an electromagnetic wave from slots provided to a wave guide, a so-called triplate antenna for feeding power through a triplate line by providing a coupling slot on a board and others.

However, among these antennas, an antenna using a wave guide is disadvantageously difficult to be manufactured since it has a three-dimensional structure partitioned by a metal wall.

Further, the triplate antenna has a large line loss although it is not as large as that of a micro-strip line, and unnecessary waves caused due to reflections of radiating elements are transmitted in the triplate line, which prevents the efficiency of the antenna to increase.

Therefore, there is proposed a parallel-plate slot array antenna in which a transmission guide which is equivalent to a wave guide is constituted by upper and lower metal surfaces of a printed board and through-holes formed so as to pieces the metal surfaces (TECHNICAL REPORT OF IEICE. A.P 99-114, RCS99-11 (199-10)).

However, the parallel-plate slot array antenna constituting the transmission guide equivalent to the wave guide by using the through-holes to the printed board as mentioned above is structurally complicated as compared with the dielectric leaky-wave antenna, and its manufacturing cost involved by processing of the through-holes is increased.

Further, in the case of this antenna, since a uniform electromagnetic field mode, i.e., a TEM mode is used in a cross section which is vertical to the transmission direction, the same strong electric current flows to the upper and lower metal plates, and the conductor loss is generated, which is a factor of occurrence of the large loss.

Furthermore, since a dielectric plate is actually inserted to the parallel plates in order to shorten the guide wavelength and suppress the grating lobe, the dielectric loss is also generated, and there is a limit in reducing the loss.

Moreover, as another type of antenna, there is proposed a leaky-wave antenna in which a dielectric rod for radiation which has a narrow width is arranged on a dielectric slab having a double-layer structure to provide a transmission line, the height of the transmission line is partially changed and metal strips are cyclically provided to lower parts (U.S. Pat. No. 4,835,543, "Dielectric slab antenna").

This is a one-dimensional array antenna. In order to obtain a two-dimensional antenna which is practically important, however, since a plurality of dielectric rods for radiation must be arranged, the mass production property is poor, and a power feeding system to these rods in phase becomes complicated.

Besides, there is proposed a method by which a dielectric slab having a projection portion in a direction vertical to the plate is manufactured, the surface of the slab is metalized in order to form a continuous transverse slub and the obtained slub is utilized for an antenna (U.S. Pat. No. 5,266,961 "Continuous transverse slub element devices and method of making same").

This is a slot array antenna which is uniform in the transverse direction and uses a parallel-plate wave guide in which a dielectric is inserted. However, a dielectric material such as alumina is generally difficult to be processed at a high frequency of, e.g., a millimeter wave and with low loss. Manufacturing the complicated dielectric slab having many protrusions leads to the problems in cost.

Thus, there has been expected realization of a planar antenna which has a simple structure and the high efficiency and can emit various kinds of polarized electromagnetic waves respectively suitable for an automotive radar or a wireless LAN.

Therefore, the present international patent applicant (inventor) filed a patent application "dielectric leaky-wave antenna (double-layer structure)" to Japan (JPA2000-54487, JPA2000-22471), United States (dielectric leaky-wave antenna filed on Dec. 19, 2000) and Europe (EPA00127989.2).

This "dielectric leaky-wave antenna (double-layer structure)" greatly reduces the electric currents flowing to a ground plane and the conductor loss and realizes the high efficiency by providing a small air layer between the ground plane and a dielectric slab (plate) and obtaining the double-layer structure.

Moreover, by providing such a double-layer structure, since a metal strip can be also printed on a back surface of the dielectric slab, reflection in the line can be suppressed.

In an antenna for the 76 GHz band manufactured by way of trial based on these techniques, the antenna efficiency of 76% which is far greater than the conventional antenna efficiency of approximately 50% is realized.

Meanwhile, when trying to apply the "dielectric leaky-wave antenna (double-layer structure)" to a low-frequency domain of a quasi-millimeter wave or a millimeter wave for wireless access (for example, FWA: Fixed Wireless Access) and the like in the 20 GHz band, the wavelength becomes approximately two fold to three fold. Therefore, the necessary thickness of the dielectric slab becomes as thick as approximately 2 mm, whereas the conventional thickness is approximately 0.6 to 0.8 mm.

Thus, such a thickness (approximately 2 mm) can not be realized easily by using alumina which is generally used for such a dielectric slab because of technical problems in manufacture. In addition, since the board having a special thickness which can not be observed in the standard size is necessary, the cost for materials is disadvantageously increased.

Therefore, the inventor of this international patent application has obtained the following knowledge by eagerly adding examination in order to apply the above-described "dielectric leaky-wave antenna (double-layer structure)" to communication in a quasi-millimeter wave region such as a 20 GHz band, e.g., wireless access, an indoor wireless LAN and the like, or a low-frequency domain of a millimeter wave.

At first, the important knowledge is that, by providing a "dielectric leaky-wave antenna having a single-layer structure" of a so-called image guide type in which a dielectric slab is laid on a ground plane, the thickness of the dielectric slab can be ½ of the thickness in case of applying the above-described "dielectric leaky-wave antenna (double-layer structure)" to the quasi-millimeter wave region (not more than approximately 1 mm). Therefore, the board having the thickness of approximately 0.6 to 0.8 mm in the standard size can be used.

Another knowledge is that, by providing such a "dielectric leaky-wave antenna having a single-layer structure", although the entire conductor loss is increased as compared with the case when providing an air layer as in the above-mentioned "dielectric leaky-wave antenna (double-layer structure)", the conductor loss itself is in proportion to a square-root of a frequency. Therefore, the influence of the conductor loss is relatively small in the quasi-millimeter wave region.

Still another knowledge is that, in such a "dielectric leaky-wave antenna having a single-layer structure", the antenna structure in which uniform metal strip rows are provided in the transverse direction on the dielectric slab surface or a reflection suppression strip is provided on the same surface is also common to the above-described "dielectric leaky-wave antenna (double-layer structure)".

DISCLOSURE OF INVENTION

In view of the above-described prior art problems and the knowledge for those problems, it is an object of the present invention to provide a dielectric leaky-wave antenna having a single-layer structure which is effective for realizing a low-cost antenna with high efficiency in a quasi-millimeter wave region in particular.

To achieve this object, according to the present invention, (1) there is provided a dielectric leaky-wave antenna comprising:
- a ground plane;
- a dielectric slab which is laid on one surface of the ground plane, and forms a transmission guide for transmitting an electromagnetic wave from one end side to the other end side along the surface between the ground plane and itself;
- perturbations which are loaded along the electromagnetic transmission direction of the transmission guide on the surface of the dielectric slab at predetermined intervals, and leak electromagnetic wave from the surface of the dielectric slab; and
- a feed which supplies the electromagnetic wave to one end side of the transmission guide.

Further, according to the present invention, (2) there is provided the dielectric leaky-wave antenna defined in the above (1), wherein the perturbation has a length which is substantially equal to a width of the dielectric slab, and is constituted by a metallic strip or a slot which is orthogonal to the electromagnetic wave transmission direction of the transmission guide.

Furthermore, according to the present invention, (3) there is provided the dielectric leaky-wave antenna defined in the above (1), wherein the perturbation is constituted by a metallic strip or a slot having an angle of 45 degrees with respect to the electromagnetic wave transmission direction of the transmission guide.

Moreover, according to the present invention, (4) there is provided the dielectric leaky-wave antenna defined in the above (2) or (3), wherein a pair of perturbations arranged in parallel to each other in such a manner that an interval along the electromagnetic wave transmission direction of the transmission guide becomes approximately ¼ of a wavelength of the electromagnetic wave in the transmission guide are loaded at the predetermined intervals along the electromagnetic wave transmission direction of the transmission guide.

In addition, in order to achieve the-above described object, according to the present invention, (5) there is provided a dielectric leaky-wave antenna, wherein the perturbation is constituted by a pair of metallic strips or a pair of slots which form an angle of 90 degrees and respectively have an angle of 45 degrees with respect to the electromagnetic wave transmission direction of the transmission guide.

Additionally, in order to achieve the above-described object, according to the present invention, (6) there is provided the dielectric leaky-wave antenna defined in (5), wherein an interval between the metallic strips forming a pair or the slots forming a pair is set to approximately ¼ or ½ of a wavelength of the electromagnetic wave in the transmission guide.

Further, in order to achieve the above-described object, according to the present invention, (7) there is provided the dielectric leaky-wave antenna defined in the above (1), wherein the feed is constituted so as to radiate a cylindrical wave, and a wave-front conversion section for converting a cylindrical wave radiated from the feed into a plane wave and leading it to the transmission guide is provided to one end side of the dielectric slab.

Furthermore, in order to achieve the above-described object, according to the present invention, (8) there is provided the dielectric leaky-wave antenna defined in the above (7), wherein the wave-front conversion section is formed by extending the dielectric slab to the feed side.

Moreover, in order to achieve the above-described object, according to the present invention, (9) there is provided the dielectric leaky-wave antenna defined in the above (8), wherein the feed is formed so as to transmit the electromagnetic wave inputted from one end side thereof to one end side of the dielectric slab along the ground plane and radiate it from an aperture portion on the other end side formed so as to surround an edge portion on one end side of the dielectric slab, and a matching section which projects toward the ground plane side so that a gap between itself and the surface of the wave-front conversion section becomes gradually or continuously small toward the wave-front conversion section is provided to the aperture portion on the other end side of the feed in order to match the feed with the wave-front conversion section.

In addition, in order to achieve the above-described object, according to the present invention,

(10) there is provided the dielectric leaky-wave antenna defined in the above (8), wherein a matching section for matching the feed and the wave-front conversion portion and leading the electromagnetic wave supplied from the feed to the wave-front conversion section is provided to a leading end of the wave-front conversion section.

Additionally, in order to achieve the above-described object, according to the present invention,

(11) there is provided the dielectric leaky-wave antenna defined in the above (7), wherein the wave-front conversion section has a reflecting wall which converts a cylindrical wave into a plane wave and one half portion of the reflecting wall is arranged so as to face one end side of the dielectric slab, and the feed is arranged on the opposite side to the dielectric slab with the ground plane therebetween so as to illuminate the other half portion of the reflecting wall of the wave-front conversion section.

Further, in order to achieve the above-described object, according to the present invention,

(12) there is provided the dielectric leaky-wave antenna defined in the above (11), wherein a matching section for matching the wave-front conversion section with the transmission guide of the dielectric slab is provided at one end side of the dielectric slab.

Furthermore, in order to achieve the above-described object, according to the present invention,

(13) there is provided the dielectric leaky-wave antenna defined in the above (10) or (12), wherein the matching section is formed into a tapered shape so that the thickness is reduced toward the input side for the electromagnetic wave.

Moreover, in order to achieve the above-mentioned object, according to the present invention,

(14) there is provided the dielectric leaky-wave antenna defined in the above (10) or (12), wherein the matching section is constituted by a dielectric having a dielectric constant different from that of the dielectric slab.

In addition, according to the present invention, in order to achieve the above-described object,

(15) there is provided the dielectric leaky wave antenna defined in the above (12), wherein the wave-front conversion section is formed so as to transmit the electromagnetic wave reflected from the reflecting wall to one end side of the dielectric slab along the ground plane and radiate the electromagnetic wave from an aperture portion formed so as to surround an edge portion on one end side of the dielectric slab, and a matching section which protrudes to the ground plane side so that a gap between itself and the surface of the dielectric slab becomes gradually or continuously small toward the dielectric slab side is provided to the aperture portion of the wave-front conversion portion in order to match the wave-front conversion section with the transmission guide of the dielectric slab.

Additionally, according to the present invention, in order to achieve the above-described object,

(16) there is provided the dielectric leaky-wave antenna defined in the above (7), wherein the feed has a plurality of radiators having radiation center positions different from each other, and wherein the wave-front conversion section converts a cylindrical wave radiated from each of the radiators into a plane wave whose wave front inclines at an angle corresponding to the radiation center position of that radiator and supplies the obtained wave to the transmission guide.

BEST MODE FOR CARRYING OUT OF THE INVENTION

Each embodiment according to the present invention will now be described with reference to the accompanying drawings.

(First Embodiment)

Figure 1:
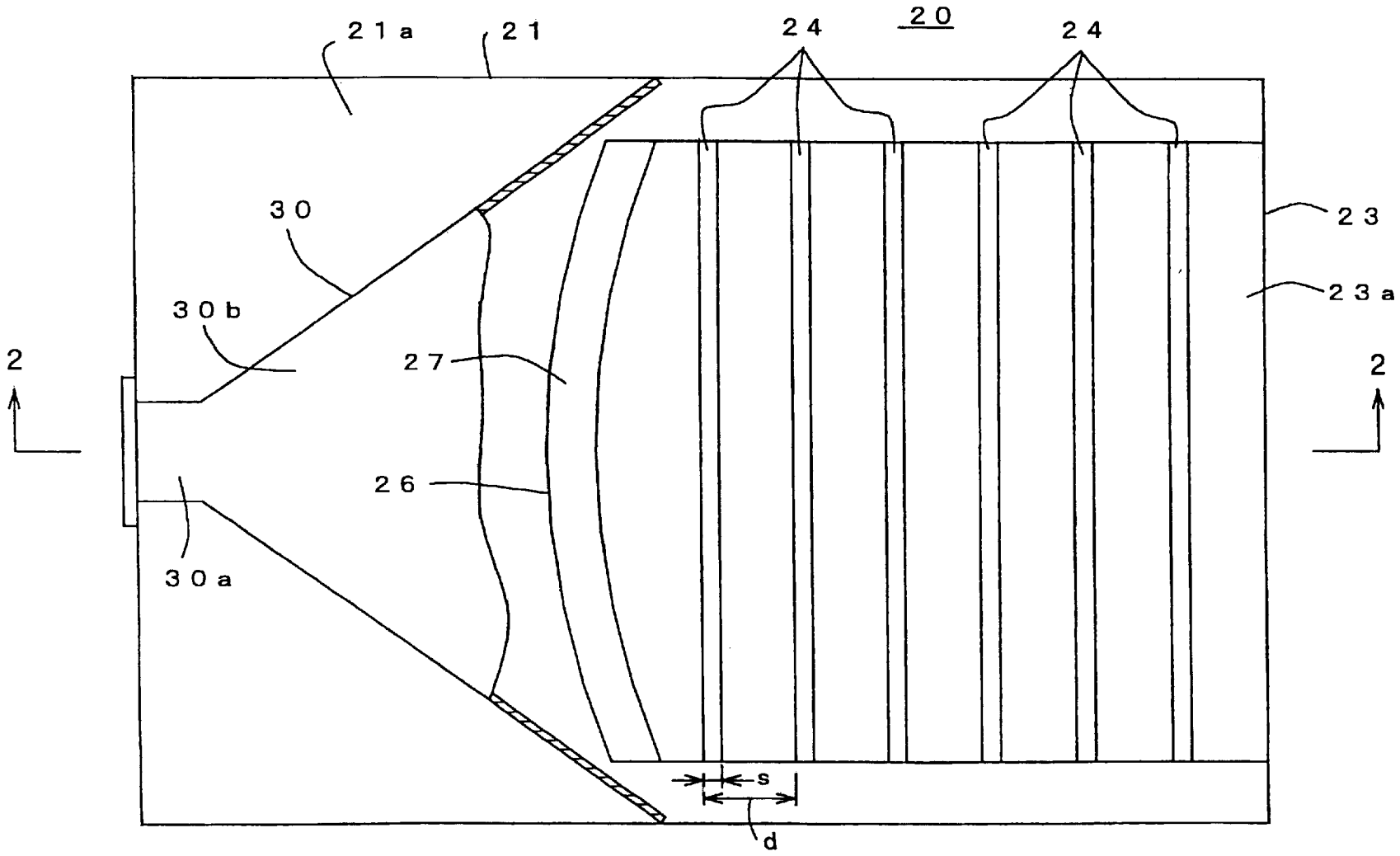
FIG. 1 is a front view for illustrating a structure of a dielectric leaky-wave antenna according to a first embodiment of the present invention.
Figure 2:
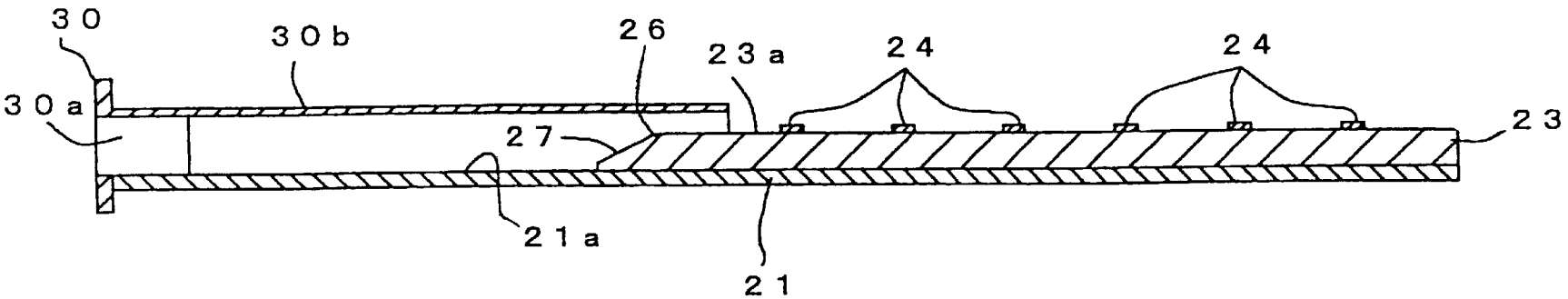
FIG. 2 is a cross-sectional view taken along the line 2—2 in FIG. 1.

FIGS. 1 and 2 show a structure of a dielectric leaky-wave antenna 20 according to a first embodiment of the present invention.

This dielectric leaky-wave antenna 20 has a ground plane 21 consisting of a metallic flat plate.

A dielectric slab 23 forming a transmission guide for transmitting an electromagnetic wave between the dielectric slab 23 and the ground plane 21 is provided on a top surface 21*a* of the ground plane 21 in such a manner that a lower surface side of the dielectric slab 23 is laid on the ground plane 21.

This dielectric slab 23 consists of a dielectric material having a high dielectric constant for transmitting an electromagnetic wave, e.g., a substantially rectangular board which is made of alumina having a relative dielectric constant Er=9.7 and has a thickness of approximately 0.5 mm. One end side of the dielectric slab 23 is extended so as to curve.

Since the dielectric constant of the dielectric slab 23 is very large, the electromagnetic wave fed from one end side intensively proceeds toward the other end side in the dielectric slab 23 having the high dielectric constant.

Since the propagation effect of the electromagnetic wave uniformly occurs in the transverse direction of the dielectric slab 23, it can be said that a rectangular portion except a curved portion extended toward one end side of the dielectric slab 23 forms one transmission guide having a wide width in which small-width transmission guides having the same length are continuously aligned in order to transmit the electromagnetic wave from one end side to the other end side.

Further, a plurality of metallic strips 24 (six in the drawing) which have a length equal to the width of the dielectric slab 23 and a predetermined width s and are orthogonal to the transmission guide are provided on a top surface of the rectangular portion (transmission guide portion) of the dielectric slab 23 so as to be parallel to each other at predetermined intervals d as perturbations of this embodiment.

It is to be noted that the thickness of the metallic strip is actually in the $\mu$m order and negligibly thin as compared with the thickness of the dielectric slab since the metallic strip is pattern-formed. In the drawing, however, the thickness is shown exaggerated for better understanding.

As described above, when the metallic strips 24 orthogonal to the transmission guide are provided on the dielectric slab 23 at predetermined intervals d so as to be parallel to each other, space harmonics are generated in the electromagnetic waves proceeding in the slab, and specific electromagnetic waves leak from the slab surface.

In general, a radiation direction of this leaky wave (angle with an axis orthogonal to the slab as a reference) can be represented by the following expression:

$$\phi n=\sin^{-1}\{\beta/ko\}+n(\lambda o/d)\}$$

where

β is a propagation coefficient of the unperturbed dielectric guide;

ko is a propagation coefficient in a free space; and n is an integer, and the interval d is usually selected so that only n=−1 mode becomes a radiation wave.

Furthermore, a quantity of radiation of the leaky wave is mainly determined by a width s of the metallic strip 24.

Therefore, when the electromagnetic wave is supplied from one end side of the slab in the longitudinal direction (direction orthogonal to the metallic strips 24) to the dielectric slab 23, the leaky wave having the intensity determined by the width s of the metallic strip is radiated in a direction determined by the interval d of the metallic strip 24.

On the other hand, the portion extended so as to curve on one end side of the dielectric slab 23 is a wave-front conversion section 26 for converting a cylindrical wave radiated from a later-described feed 3C into a plane wave and inputting it to one end side of the transmission guide section (rectangular portion) of the dielectric slab 23 in phase.

In this embodiment, since this wave-front conversion section 26 is extended in such a manner that the dielectric slab 23 is caused to form a dielectric lens toward one end side thereof, the wave-front conversion section 26 converts the cylindrical wave having a radiation center at its focusing position into a planar wave which is parallel to the transverse direction of the transmission guide of the dielectric slab 23.

To a front edge of this wave-front conversion section 26 is provided a matching section 27 for matching the wave-front conversion section 26 with the later-described feed 30.

Although this matching section 27 has a simple structure which is tapered so that the height becomes smaller toward the feed 30 side, the matching section 27 can efficiently lead the electromagnetic wave from the feed 30 to the wave-front conversion section 26.

This feed 30 is of an electromagnetic horn type consisting of a wave guide section 30*a* and a horn section 30*b* and radiates the electromagnetic wave inputted from the wave guide section 30*a* to the wave-front conversion section 26.

Here, as the feed 30, there is employed an H-plane sectoral horn type or an E-plane sectoral horn type by which the small height at the radiation aperture can suffice.

Further, the H-plane sectoral horn type feed 30 radiate a TM wave which does not have a longitudinal component of magnetic field H.

Furthermore, the E-plane sectoral horn type feed 30 radiates a TE wave which does not have a longitudinal component of electric field E.

By such an H-plane or E-plane sectoral horn, the surface wave-front (isophase surface) of the radiated electromagnetic wave becomes a cylindrical surface as long as the horn section 30*b* is not extremely long.

Thus, as described above, the cylindrical wave radiated from this feed 30 becomes a plane wave by the wave-front conversion section 26, and the obtained wave enters one end side of the transmission guide formed by the dielectric slab 23 in phase.

Therefore, the surface of the dielectric slab 23 radiates the leaky wave which is in phase in the transverse direction.

That is, when the feed 30 is set on the top side or the ground side and used, the vertically polarized electromagnetic wave having a corresponding component is radiated in a plane (vertical plane) formed by the transmission direction of the electromagnetic wave in the dielectric slab 23 and the direction orthogonal to the slab.

As described above, the dielectric leaky-wave antenna 20 according to the first embodiment can radiate a vertically polarized electromagnetic wave from the surface of the dielectric slab 23 which is provided on the surface of the ground plane 21 and forms the transmission guide for transmitting the electromagnetic wave between the dielectric slab 23 and the ground plane 21 with a very simple structure in which the metallic strips 24 are provided as the perturbations in the transverse direction to the transmission guide.

Furthermore, in case of the above-described dielectric leaky-wave antenna 20, the metallic strips 24 which have a length equal to the width of the dielectric slab 23 and are orthogonal to the electromagnetic wave transmission direction of the transmission guide are provided in parallel to each other.

Figure 3:
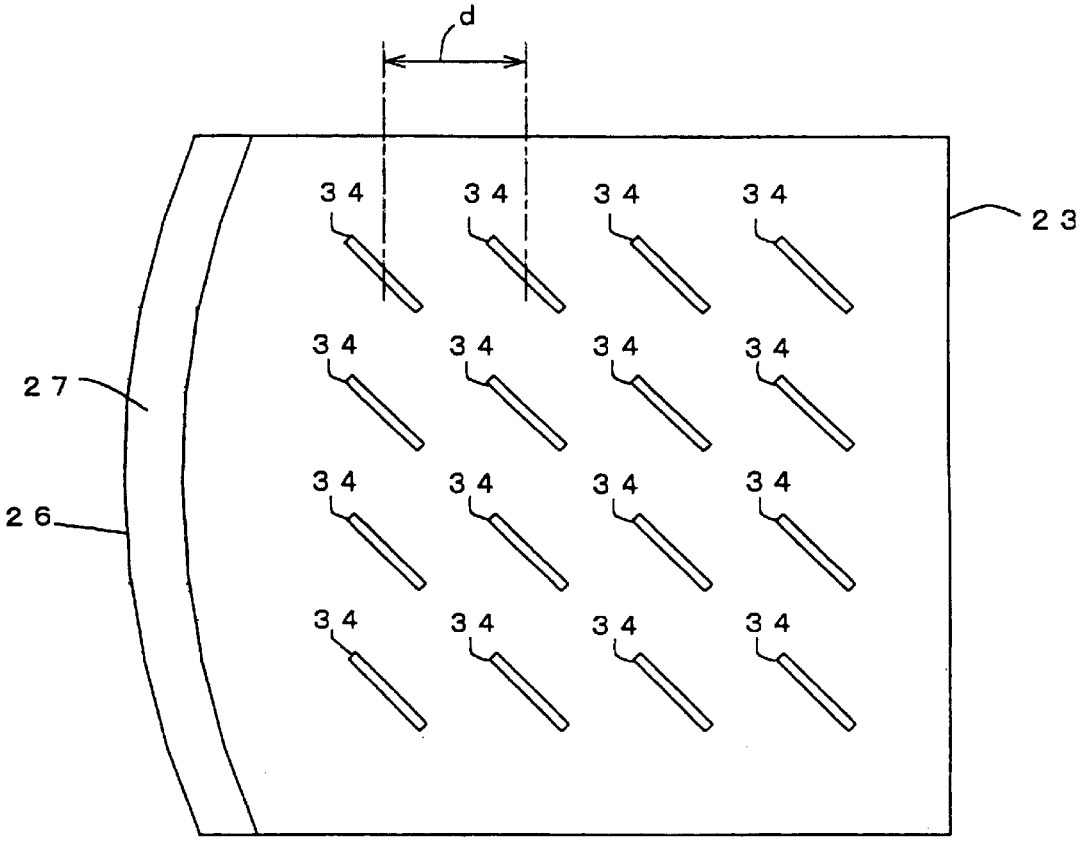
FIG. 3 is a view showing a modification of a perturbation depicted in FIG. 1.

Thus, as shown in FIG. 3, when the metallic strips 34 which have the angle of 45 degrees relative to the electromagnetic wave transmission direction of the transmission guide are arranged as the perturbations at intervals d in the electromagnetic wave transmission direction of the transmission guide and arbitrary intervals in the transverse direction of the transmission guide, the 45-degree linearly polarized electromagnetic wave can be readily radiated as the dielectric leaky-wave antenna.

In this case, if the length of each metallic strip 34 is selected to be a resonance length and a dipole is provided, then, the high-frequency electric current is induced, and this results in leak of the electromagnetic wave having the 45-degree line polarization.

As described above, enabling radiation of the 45-degree linearly polarized electromagnetic wave as the dielectric leaky-wave antenna can satisfy essential requirements as an antenna for a radar mounted in an automobile.

That is, when a radar device is used to detect a preceding automobile and control traveling, although a radar wave from an automobile running in an opposite lane becomes an interfering wave, using the 45-degree linear polarization causes the electromagnetic wave from the oncoming car to be orthogonal to the polarization direction of the antenna of its own car, thereby avoiding interference.

Figure 4:
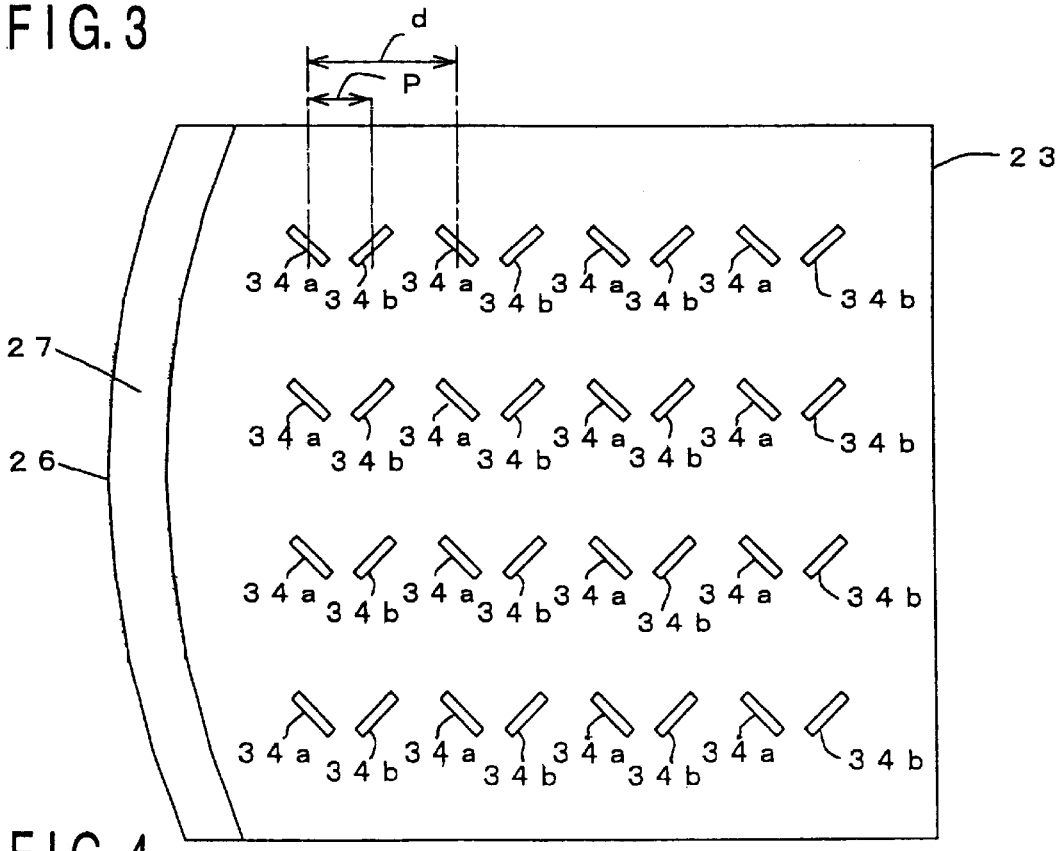
FIG. 4 is a view showing a modification of the perturbation illustrated in FIG. 1.

Moreover, as shown in FIG. 4, when a pair of metallic strips 34*a* and 34*b* which are aligned in the V shape so as to form an angle of 90 degrees as the perturbations are arranged so as to respectively form an angle of 45 degrees relative to the electromagnetic wave transmission direction of the transmission guide at the interval d in the electromagnetic wave transmission direction of the transmission guide and at a predetermined interval in the transverse direction of the transmission guide, varying the spacing P between the pair of the metallic strips 34*a* and 34*b* can change the polarization state including the horizontal polarization and the circular polarization.

Figure 5:
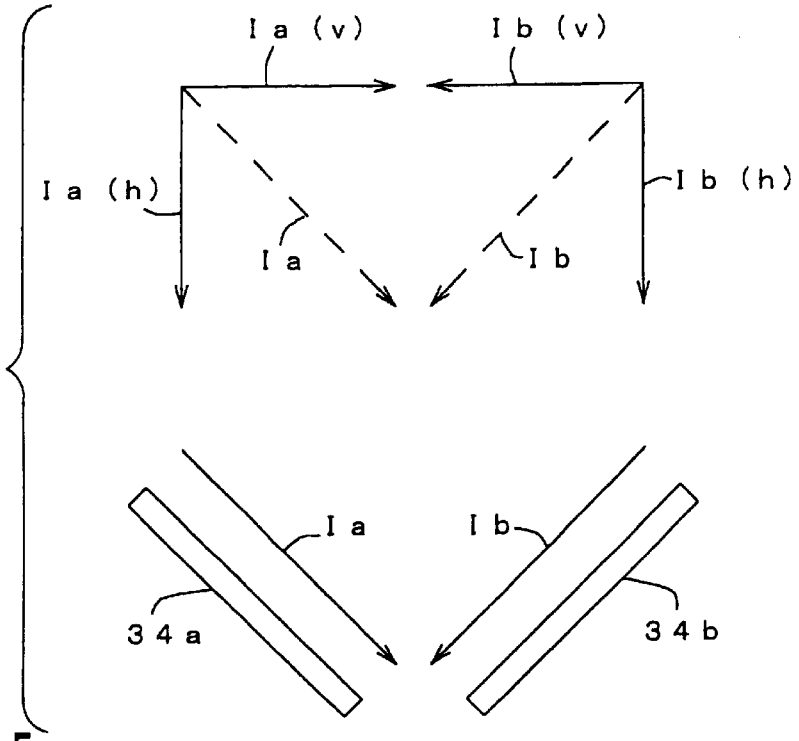
FIG. 5 is a view for illustrating the effects obtained by the perturbation depicted in FIG. 4.

For example, when the pair of metallic strips 34a and 34*b* are provided with a spacing of $P=\lambda g/2$, high-frequency electric currents Ia and Ib along the lengthwise direction of the respective metallic strips 34*a* and 34*b* symmetrically flow as shown in FIG. 5. Their horizontal components (components in the vertical direction in FIG. 5) Ia(h) and Ib(h) are added in phase and vertical components Ia(v) and Ib(v) are canceled out in opposite phases, thereby radiating the horizontally polarized electromagnetic wave.

In addition, although not shown, when the pair of metallic strips 34*a* and 34*b* are provided with a spacing $P=\lambda g/4$, the directions of the electric currents flowing along the pair of metallic strips 34*a* and 34*b* become spatially orthogonal to each other and a difference in phase is thereby 90 degrees. Therefore, the circularly polarized electromagnetic wave whose polarization plane rotates is radiated.

Additionally, in the foregoing embodiment, although the metallic strips 24 and 34 are used as the perturbations, slots can substitute for these metallic strips.

Figure 6:
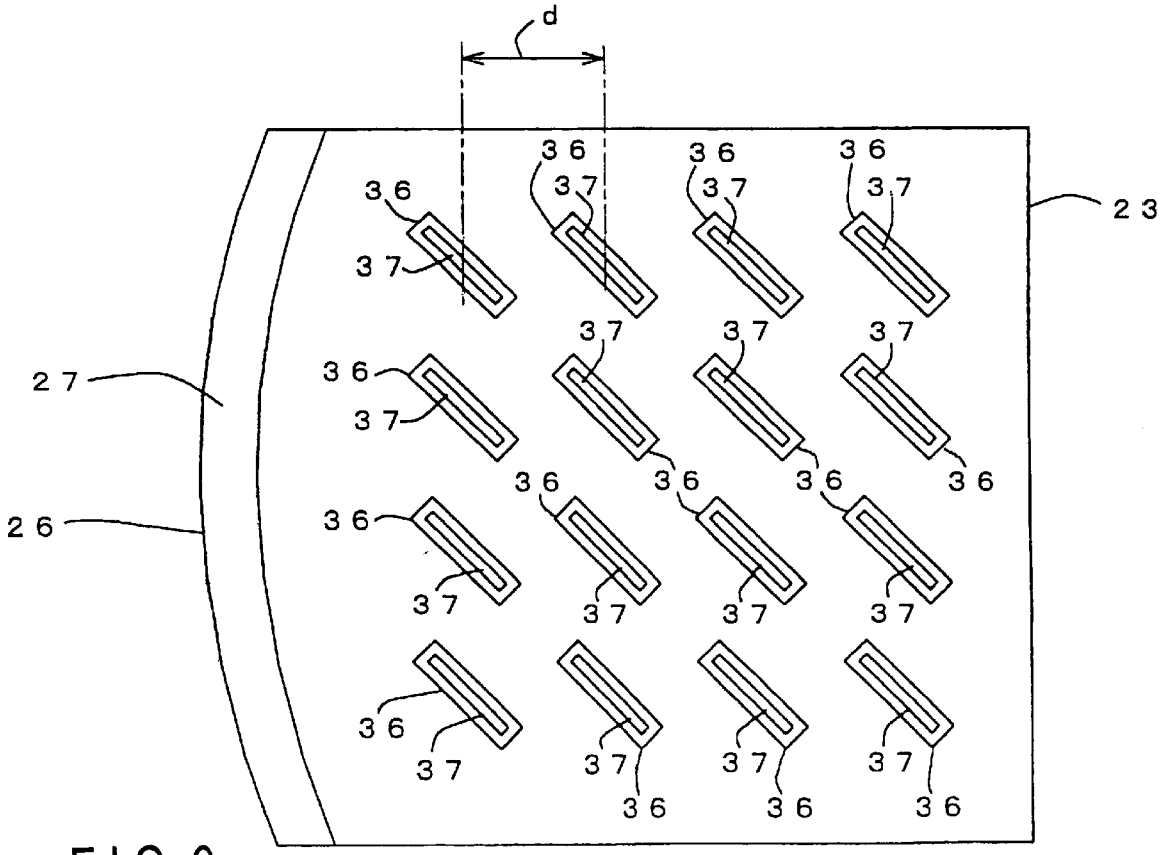
FIG. 6 is a view showing a modification of the perturbation depicted in FIG. 1.

For example, when each slot 37 formed in a metal frame plate 36 is provided at an angle of 45 degrees relative to the electromagnetic wave transmission direction of the transmission guide as the perturbation in place of the metallic strip 34 as shown in FIG. 6, the 45-degree linearly polarized electromagnetic wave can be radiated as similar to the case of the metallic strip 34.

Further, although not shown, when slots which have a length substantially equal to the width of the dielectric slab 23 and are orthogonal to the electromagnetic wave transmission direction of the transmission guide are provided as the perturbation in parallel to each other with a interval d therebetween in place of the metallic strip 24, the vertical linearly polarized electromagnetic wave can be radiated.

Furthermore, although not shown, when a pair of slots which are aligned in the V shape so as to form an angle of 90 degrees are provided so as to respectively form an angel of 45 degrees relative to the electromagnetic wave transmission direction of the transmission guide at the interval d in the electromagnetic wave transmission direction of the transmission guide and a predetermined interval in the transverse direction of the transmission guide in place of the pair of metallic strips 34*a* and 34*b* and the spacing between the pair of slots is determine as $\lambda g/2$, the horizontal linearly polarized electromagnetic wave can be radiated.

Moreover, in this case, when the spacing between the pair of slots is determined as $\lambda g/4$, the circularly polarized electromagnetic wave can be radiated.

Additionally, in the above-described embodiment, the metallic strips 24 and 34, the slot 37 or the pair of metallic strips 34*a* and 34*b* as the perturbations are arranged on the dielectric slab 23 at predetermined intervals d.

On the other hand, when a pair of perturbations arranged in parallel to each other with a spacing of approximately ¼ of the wavelength in the transmission guide $\lambda g$ are arranged with a predetermined interval d along the transmission direction of the electromagnetic wave, reflection of the electromagnetic wave transmitted in the transmission guide caused by the perturbations can be reduced.

Figure 7:
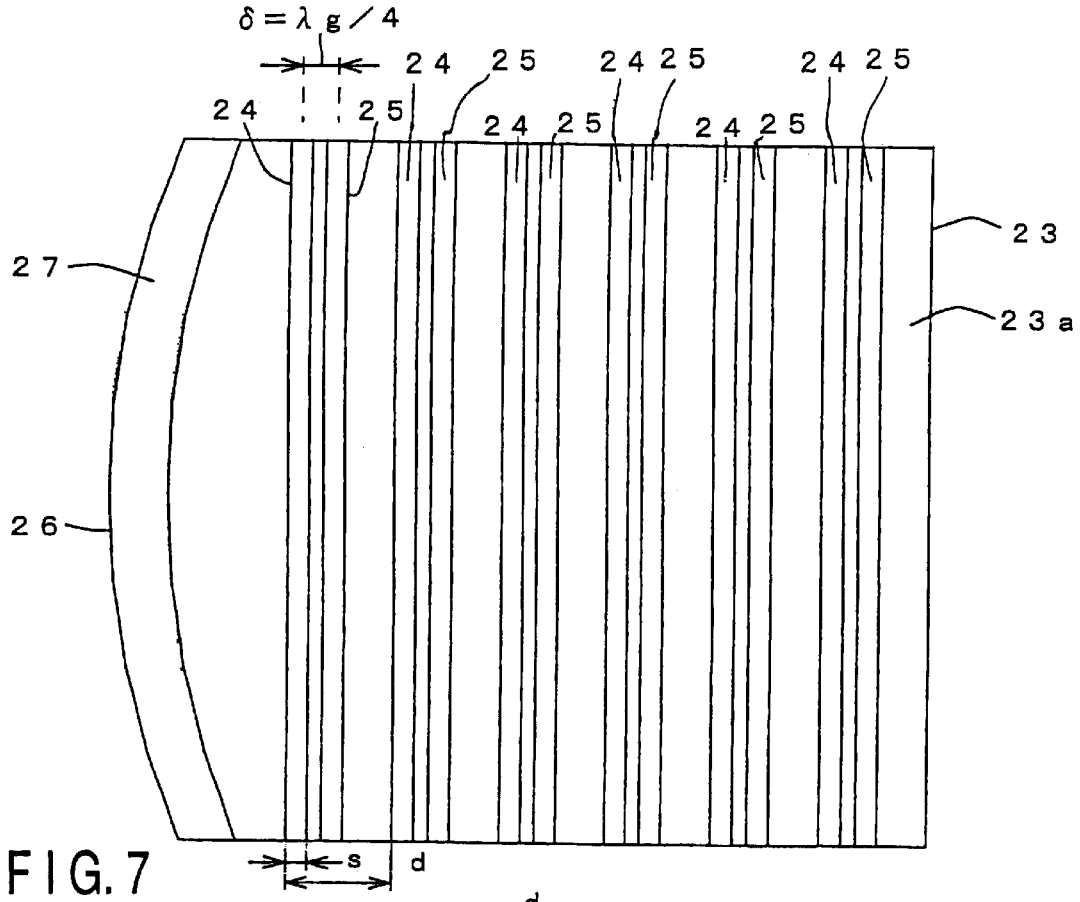
FIG. 7 is a view showing a modification of the perturbation illustrated in FIG. 1.

For example, as shown in FIG. 7, metallic strips 24 and 25 which have a length equal to the width of the dielectric slab 23, are orthogonal to the electromagnetic wave transmission direction of the transmission guide and arranged in parallel to each other with a spacing $\delta$ which is substantially ¼ of the wavelength in the transmission guide $\lambda g$ are provided along the electromagnetic wave transmission direction of the transmission guide with a predetermined interval d as a pair of perturbations.

Figure 8:
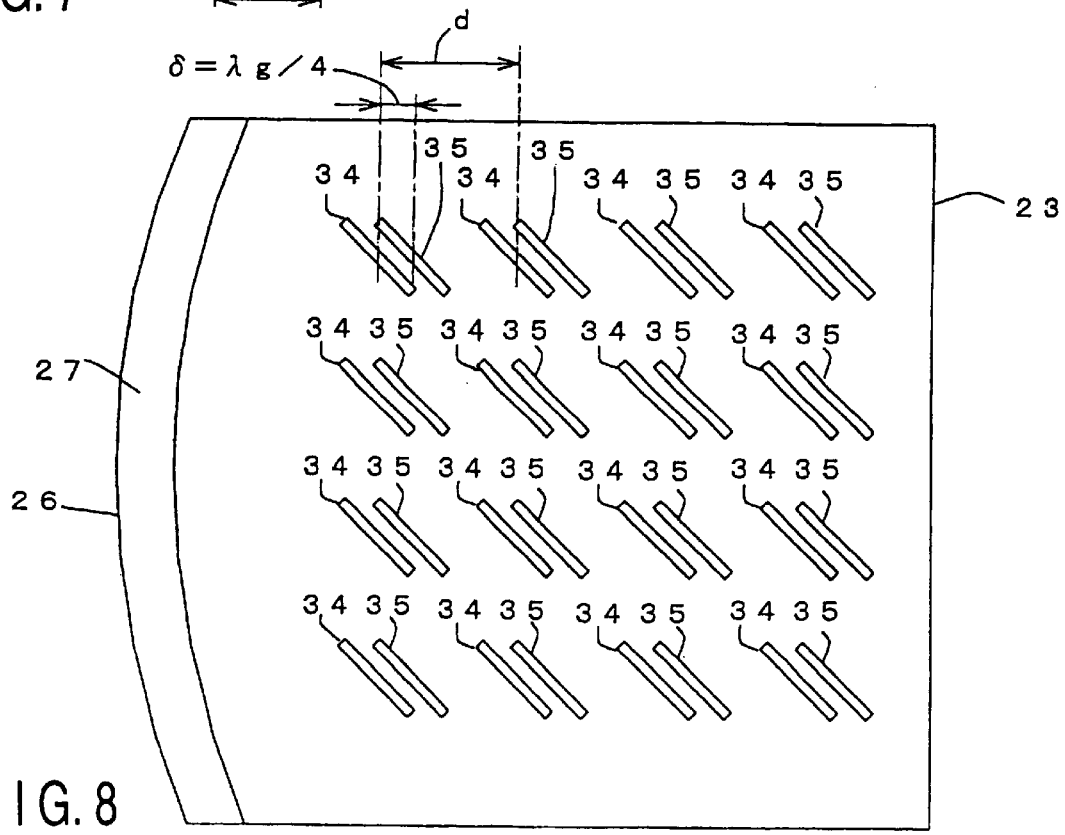
FIG. 8 is a view showing a modification of the perturbation depicted in FIG. 1.

In addition, a shown in FIG. 8, metallic strips 34 and 35 which form an angle of 45 degrees relative to the electromagnetic wave transmission direction of the transmission guide and are arranged in parallel to each other with a gap which is substantially ¼ of the wavelength in the transmission guide are provided along the electromagnetic wave transmission direction of the transmission guide with a predetermined interval d as a pair of perturbations.

Figure 9:
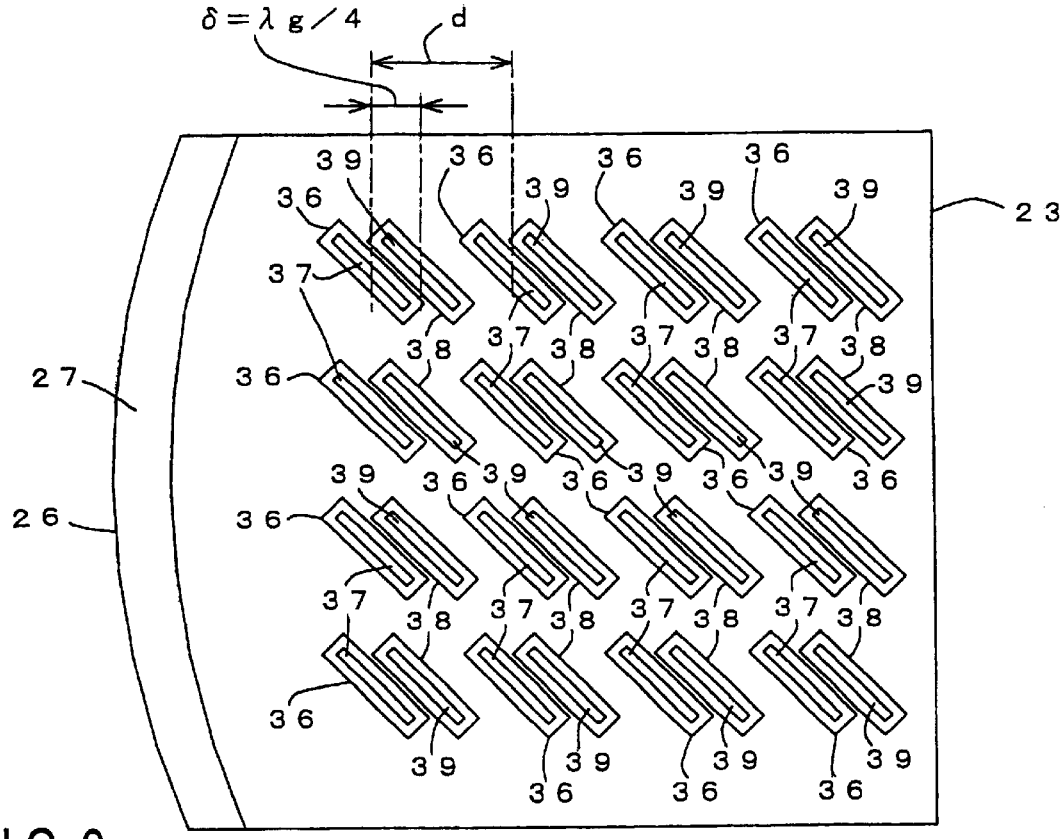
FIG. 9 is a view showing a modification of the perturbation illustrated in FIG. 1.

Further, as shown in FIG. 9, slots 37 and 39 (reference numeral 38 denotes a metal frame plate) which form an angle of 45 degrees relative to the electromagnetic wave transmission direction of the transmission guide and are arranged in parallel to each other with a spacing which is approximately ¼ of the wavelength in the transmission guide are provided along the electromagnetic wave transmission direction of the transmission guide with a predetermined interval d as a pair of perturbations.

With the above-described structure, an electromagnetic wave reflecting component caused by one of the pair of perturbations and an electromagnetic wave reflecting component caused by the other one of the same can be canceled out.

This will now be described by taking an instance where a pair of perturbations are the metallic strips 24 and 25 shown in FIG. 7.

Figure 10A:
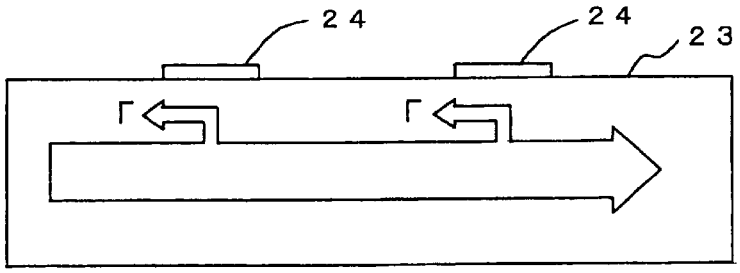
FIGS. 10A and 10B are views for illustrating the effects obtained by the perturbation shown in FIG. 7.
Figure 10B:
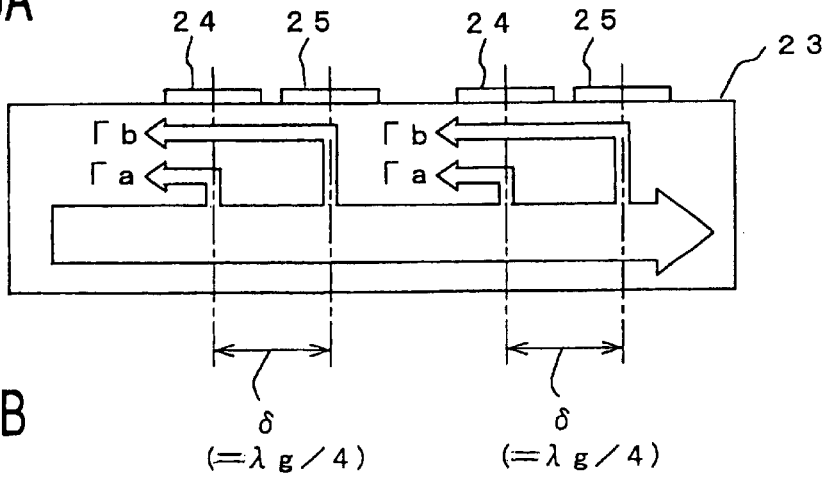

That is, as shown in FIG. 10A, when the metallic strip 25 is not provided, reflection occurs with respect to the electromagnetic wave proceeding in the dielectric slab 23 at the part of the metallic strip 24, and the electric field in the transmission guide is largely disturbed by the reflecting wave r.

On the other hand, when the gap is displaced by $\delta=\lambda g/4$ and the metallic strip 25 is provided, a difference in propagation path between the reflecting wave Γa reflected by the metallic strip 24 and the reflecting wave Γb reflected by the metallic strip 25 becomes $\lambda g/2$, and these reflecting waves are canceled out in opposite phases.

Therefore, disturbance of the electric field in the transmission guide due to the reflecting wave can be eliminated, and the characteristic which is very close to the design characteristic can be obtained.

Incidentally, when the metallic strips or the slots are provided with a gap which is ¼ of the wavelength in the transmission guide, a length or a width of each metallic strip or slot or a gap d is set in such a manner that a combined wave obtained from the electromagnetic wave leaking from one of the metallic strips or slots and the electromagnetic wave leaking from the other one can have a desired characteristic.

Alternatively, in the dielectric leaky-wave antenna 20, the wave-front conversion section 26 is constituted by the dielectric lens in which one end side of the dielectric slab 23 is extended.

(Second Embodiment)

Figure 11:
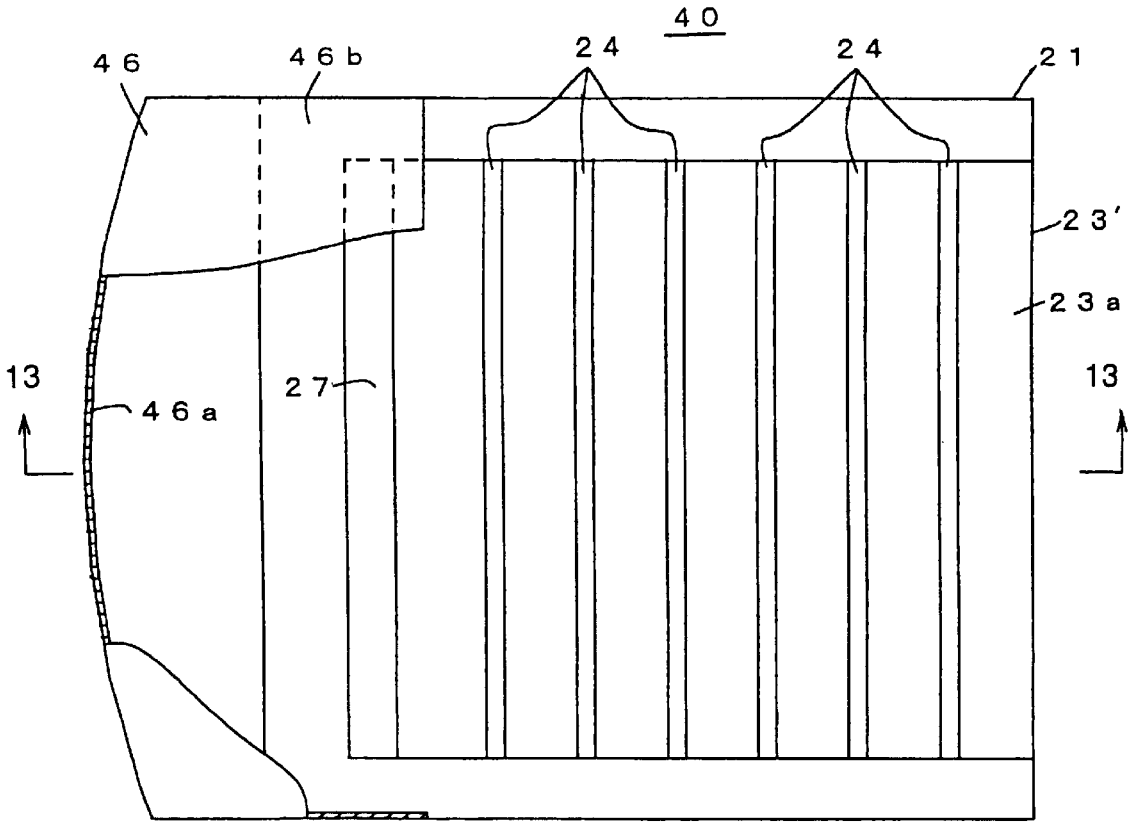
FIG. 11 is a front view for illustrating a structure when a reflecting type wave-front conversion section is used as a dielectric leaky-wave antenna according to a second embodiment of the present invention.
Figure 12:
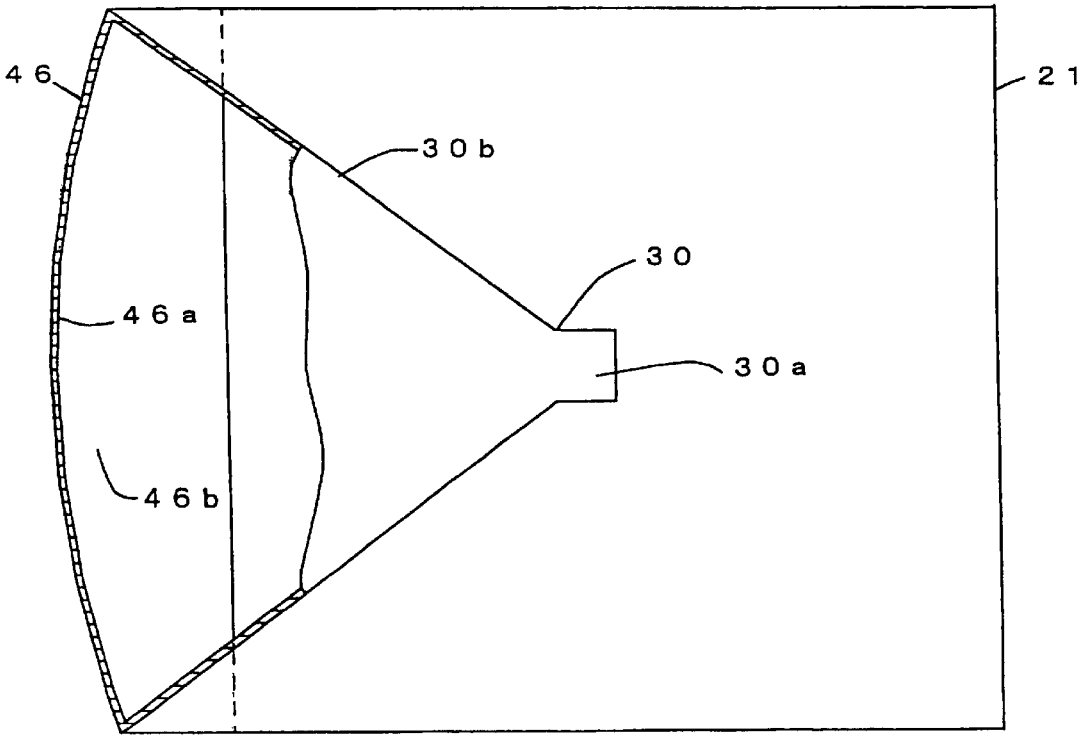
FIG. 12 is a rear view for illustrating a structure when the reflecting type wave-front conversion section is used as the dielectric leaky-wave antenna according to the second embodiment of the present invention.
Figure 13:
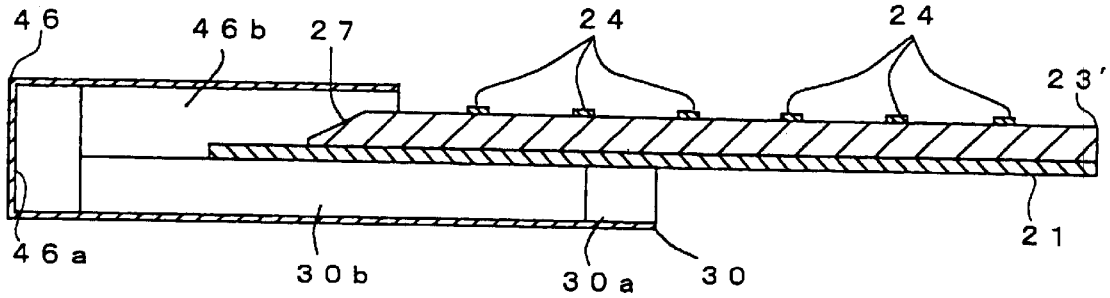
FIG. 13 is a cross-sectional view taken along the line 13—13 in FIG. 11.

On the contrary, a parabola reflecting type wave-front conversion section 46 may be used as in a dielectric leaky-wave antenna 40 according to a second embodiment shown in FIGS. 11 to 13.

FIGS. 11 to 13 show a structure of a dielectric leaky-wave antenna 40 according to the second embodiment of the present invention.

In the dielectric leaky-wave antenna 40 according to the second embodiment, the wave-front conversion section 46 has a reflecting wall 46*a* for reflecting the cylindrical wave and converting it into the plane wave and a guide section 46*b* for guiding the reflected planar wave to one end side of the dielectric slab 23'. The wave-front conversion section 46 is attached in such a manner that an upper half portion of the reflecting wall 46*a* is directed to one end side of the dielectric slab 23' and the aperture of the horn section 30*b* of the electromagnetic horn type feed 30 provided to the lower surface side of the ground plane 21 is closed by a lower half portion of the reflecting wall 46a.

Therefore, the cylindrical wave radiated from the feed 30 is reflected by the reflecting wall 46*a* of the wave-front conversion section 46, converted into the plane wave, and inputted to the transmission guide of the dielectric slab 23' in the uniform phase.

In case of this dielectric leaky-wave antenna 40, since the feed 30 is arranged on the rear surface side in order to turn back the electromagnetic wave, the length of the entire antenna can be shortened.

Further, in case of this dielectric leaky-wave antenna 40, since the dielectric lens is not required, one end side of the dielectric slab 23' can be made straight (making the outer shape rectangular). Furthermore, linearly providing the matching section 27 can suffice, and the slab processing can be hence greatly facilitated.

Moreover, in the dielectric leaky-wave antennas 20 and 40 mentioned above, the matching section 27 is manufactured into a tapered shape and formed in such a manner that the height on the surface side becomes smaller toward the input side of the electromagnetic wave.

Figure 14:
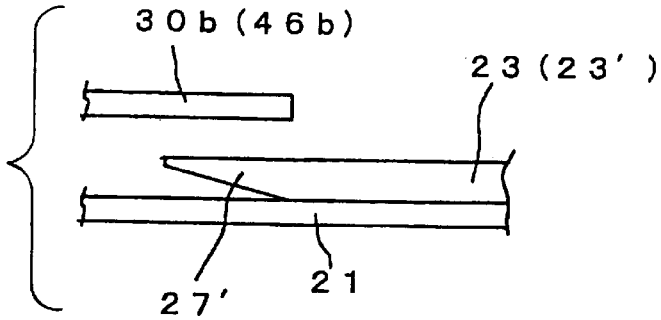
FIG. 14 is a view showing a modification of a matching section depicted in FIG. 11.

On the contrary, the matching section may be formed into a tapered shape in such a manner that the height of the surface on the ground plane 21 side becomes larger toward the input side of the electromagnetic wave, as similar to the matching section 27' shown in FIG. 14.

As described above, when the tapered portion is formed so that the height from the ground plane 21 side becomes large, the matching state can be improved, and the transmission loss can be reduced.

For example, assuming that the height of the horn section 30*b* of the feed 30 or the opening portion of the guide section 46*b* of the wave-front conversion section 46 from the ground plane 21 is 1.8 mm, the thickness of each of the dielectric slabs 23 and 23' made of alumina is 0.64 mm, the tapered length is 8.6 mm, and the thickness of an end of the tapered portion is 0.2 mm, the transmission loss was analyzed. As a result, it was confirmed that, when using the above-described matching section 27', the transmission loss is reduced by approximately 0.8 dB in a frequency range of 60 to 90 GHz as compared with the case of using the matching section 27 and the fluctuation range becomes greatly small.

Incidentally, when using the matching sections 27 and 27' mentioned above, the end of each of the dielectric slabs 23 and 23' must be processed into a tapered shape.

In this case, since fracture or crack may be possibly generated to the dielectric slab due to taper processing, the matching section may be formed by providing a matching dielectric having a dielectric constant different from those of the dielectric slabs 23 and 23' to the end in place of performing taper processing.

Figure 15A:
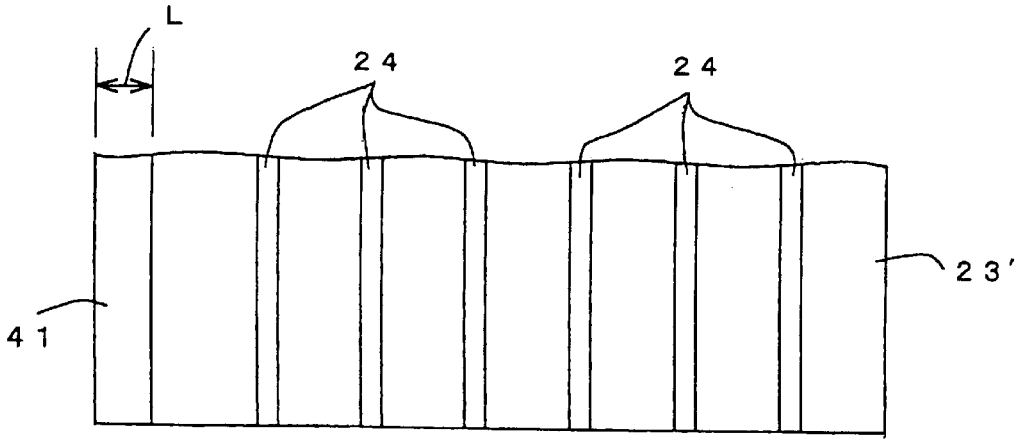
FIGS. 15A and 15B are a plan view and a side view showing a modification of the matching section illustrated in FIG. 11.
Figure 15B:
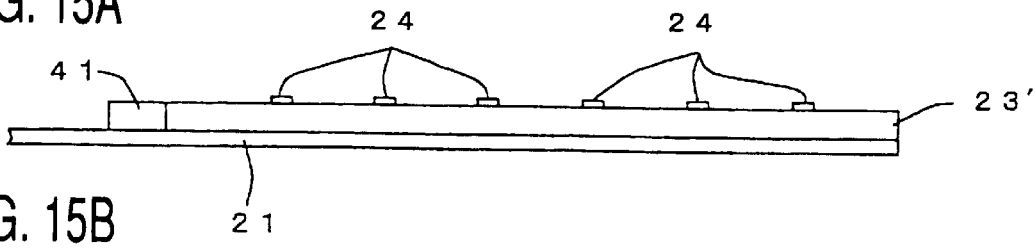

For example, as shown in FIG. 15, a matching dielectric 41 having a relative dielectric constant E1 and a width L is attached to the end of the dielectric slab 23' in order to carry out matching.

In this case, it is desirable that the length L of the matching dielectric 41 is set so as to be equal to ¼ of the wavelength in the guide $\lambda g$. Also, assuming that the relative dielectric constant of the dielectric slab 23' (or the dielectric slab 23) is Er and the relative dielectric constant in the guide section 46*b* of the wave-front conversion section 46 (or in the horn section 30*b* of the feed 30) is E0 (usually, 1 with air), it is desirable to select the relative dielectric constant E1 of the matching dielectric 41 in such a manner that the relationship of the following expression can be attained:

$$E1=(Er\cdot E0)^{1/2}$$

Further, in the dielectric leaky-wave antennas 20 and 40 according to the foregoing embodiments, although the matching section 27 or 27' are provided to one end side of the dielectric slab 23 or 23', the matching section can be provided to the feed 30 for supplying the electromagnetic wave to one end side of the dielectric slab 23 or 23' or to the wave-front conversion section 46 side.

Figure 16:
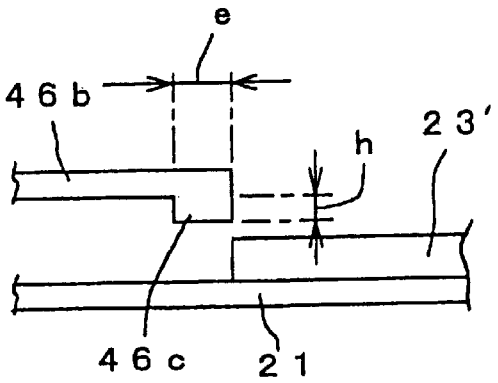
FIG. 16 is a view showing a modification of the matching section depicted in FIG. 11.

For example, as shown in FIG. 16, the matching section 46*c* which protrudes toward the ground plane 21 side by the length h is provided on the inner side of the aperture portion of the guide section 46*b* of the wave-front conversion section 46, which is opened so as to surround the edge portion on one end side of the dielectric slab 23', so as to be continuous in the transverse direction of the aperture portion with a predetermined depth e in such a manner that a gap between the matching section 46*c* and the surface of the dielectric slab 23' gradually becomes small toward the dielectric slab side.

In this case, assuming that the impedance in the guide section 46*b* is Z1 and the impedance of the transmission guide of the dielectric slab 23' is Z2, the protrusion length h and the depth e of the matching section 46*c* are set in such a manner that the impedance Z of the transmission guide formed between the matching section 46*c* and the ground plane 21 can satisfy the following expression:

$$Z=(Z1\cdot Z2)^{1/2}$$

As described above, by providing the matching section 46*c* on the inner side of the aperture portion of the guide section 46*b*, matching between the wave-front conversion section 46 and the transmission guide of the dielectric slab 23' can be achieved without additionally using the above-described matching dielectric having different taper processing or a different dielectric constant with respect to the dielectric slab.

Figure 17:
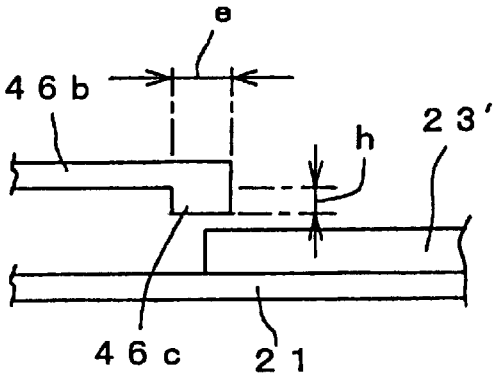
FIG. 17 is a view showing a modification of the matching section illustrated in FIG. 11.

Incidentally, in FIG. 16, although an end position of the matching section 46*c* coincides with a position of the edge portion on one end side of the dielectric slab 23', the matching section 46*c* may be arranged so as to overlap one end side of the dielectric slab 23' as shown in FIG. 17.

Moreover, the above-described matching technique can be also utilized for matching between the horn section 30*b* of the above-described feed 30 and the wave-front conversion section 26 formed so as to extend to one end side of the dielectric slab 23.

In this case, the matching section which protrudes toward the ground plane 21 side is provided on the inner side of the aperture portion of the horn section 30*b*, which is opened so as to surround the edge portion on one end side of the wave-front conversion section 23, so as to be continuous in the transverse direction of the aperture portion with a predetermined depth in such a manner that a gap between the matching section and the surface of the wave-front conversion section 26 gradually becomes small.

As described above, however, since the front end side of the wave-front conversion section 26 is curved, the matching section is also formed so as to curve in accordance with the front edge of the wave-front conversion section 26.

In addition, the above-described matching section 46*c* protrudes toward the ground plane 21 side in such a manner that the gap between the matching section 46*c* and the surface of the dielectric slab 23' gradually becomes small.

Figure 18:
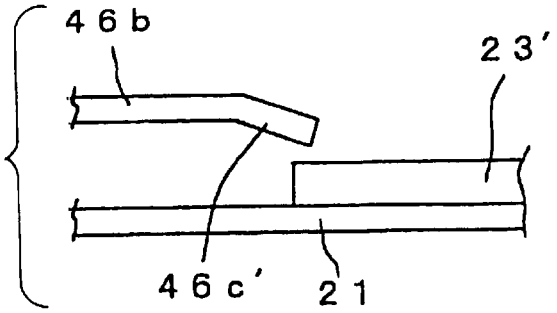
FIG. 18 is a view showing a modification of the matching section depicted in FIG. 11.

On the contrary, as shown in FIG. 18, the matching section 46*c'* may protrude toward the ground plane 21 side in such a manner that the gap between the matching section 46*c'* and the surface of the dielectric slab 23' gradually becomes small.

Additionally, as described above, this matching technique can be utilized for matching between the horn section 30*b* of the feed 30 and the wave-front conversion section 26 formed so as to extend to one end side of the dielectric slab 23.

Further, although the radiation direction (direction of a main beam) is one direction in the dielectric leaky-wave antennas 20 and 40, changing the wave-front conversion sections 26 and 46 and the feed 30 can realize the multi-beam.

(Third Embodiment)

Figure 19:
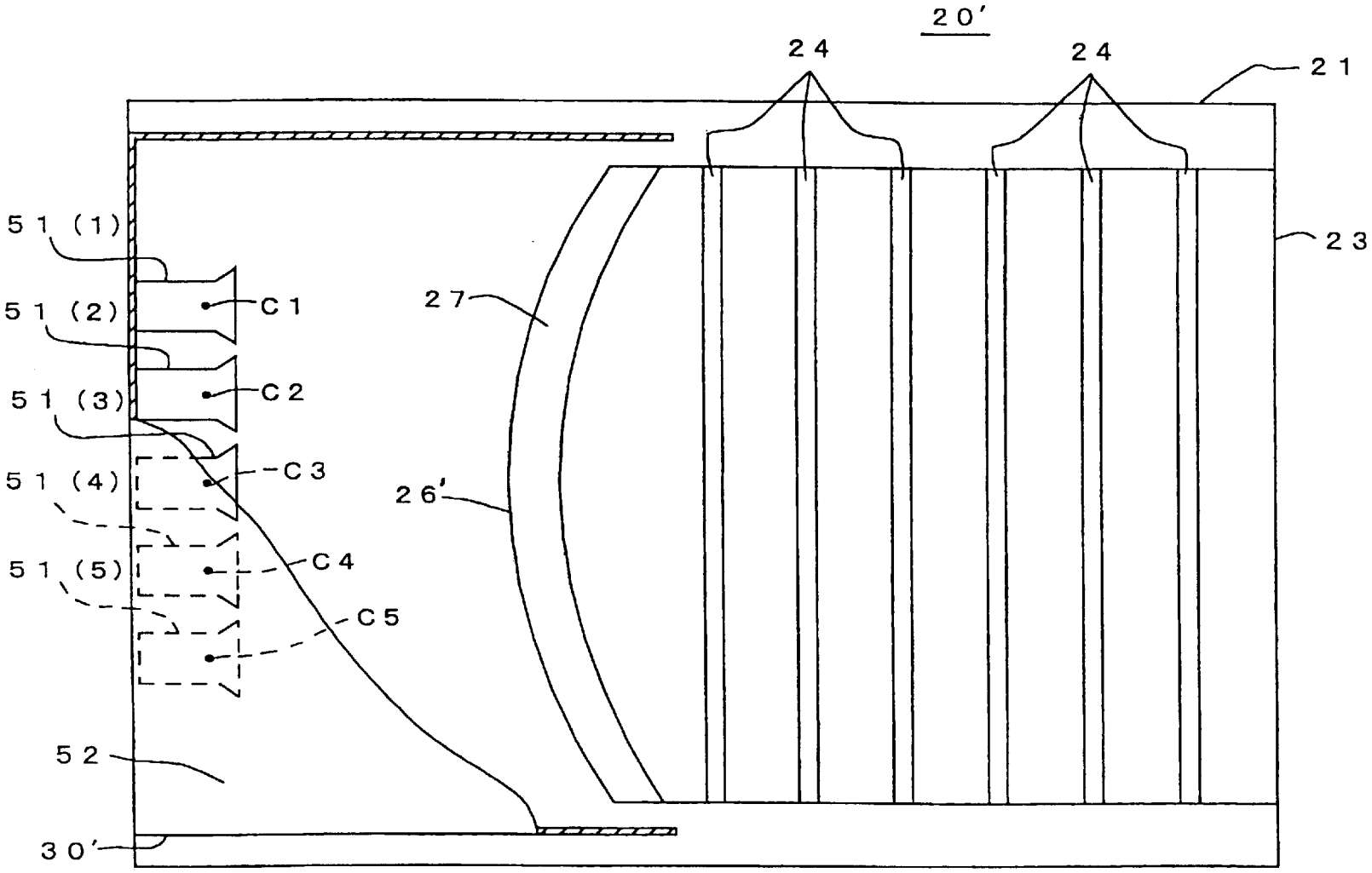
FIG. 19 is a front view for illustrating a structure when a feed and a wave-front conversion section shown in FIG. 1 are modified as a dielectric leaky-wave antenna according to a third embodiment of the present invention.

FIG. 19 is a front view for illustrating a structure when the feed and the wave-front conversion section shown in FIG. 1 are modified as a dielectric leaky-wave antenna according to a third embodiment of the present invention.

For example, when modifying the above-described dielectric leaky-wave antenna 20 to a multi-beam radiation antenna, a bifocal type wave-front conversion section 26' (dielectric lens) is provided, and a feed 30' is constituted by a plurality of, e.g., five wave guide type radiators 51(1), 51(2), . . . 51(5) and a cover 52, as in a dielectric leaky-wave antenna 20' shown in FIG. 19.

Here, phase centers C1, C2, . . . , C5 of the respective radiators are arranged on the focal plane of the wave-front conversion section 26' or in the vicinity of the same.

Figure 20:
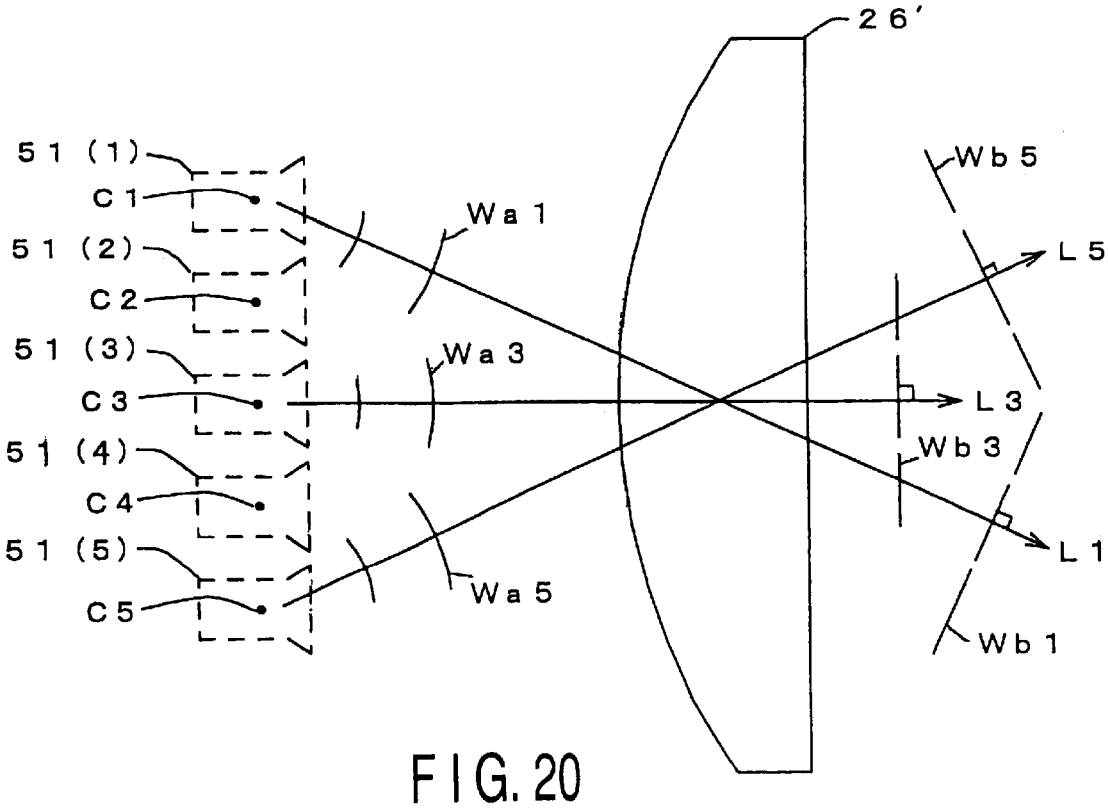
FIG. 20 is a view for illustrating the effect of the feed and the wave-front conversion section shown in FIG. 19.

In the dielectric leaky-wave antenna 20' having such a structure, as shown in FIG. 20, for example, the cylindrical wave Wa3 radiated from the central radiator 51(3) is converted as the plane wave Wb3 which is orthogonal to a line L3 running through the center of the wave-front conversion section 26' from the phase center C3 (in this case, a straight line parallel to the transmission guide of the dielectric slab 23).

Therefore, similar to the above, the electromagnetic wave is inputted to the transmission guide of the dielectric slab 23 in phase, and a beam which is orthogonal to the surface of the slab and parallel to the plane including the transmission direction of the transmission guide is radiated.

Further, for example, the cylindrical wave Wa1 radiated from the radiator 51(1) at the upper end is converted into the plane wave Wb1 which is orthogonal to a line L1 running through the center of the wave-front conversion section 26' from the phase center C1, and inputted to the transmission guide in the dielectric slab 23.

Thus, the electromagnetic wave is inputted to the transmission guide of the dielectric slab 23 with the phase lag which is prominent from the upper side toward the lower side in FIG. 20. Based on this, as to the phase of the leaky electromagnetic wave, since the phase lag is also prominent from the upper side toward the lower side (in FIG. 20), the beam direction is inclined in the direction of the phase lag (lower side in FIG. 20).

On the contrary, the cylindrical wave Wa5 radiated from the radiator 51(5) at the lower end is converted into the planar wave Wb5 which is orthogonal to a line L5 running through the center of the wave-front conversion section 26' from the phase center C5, and inputted to the transmission guide in the dielectric slab 23.

Therefore, the electromagnetic wave is inputted to the transmission guide of the dielectric slab 23 with the phase lag which is prominent from the lower side toward the upper side in FIG. 20. Based on this, as to the phase of the leaky electromagnetic wave, since the phase lag is also prominent from the lower side toward the upper side (in FIG. 20), the beam direction is inclined in a direction of the phase lag (upper side in FIG. 20).

As described above, the beam direction varies depending on the respective radiators 51(1), 51(2), . . . , 51(5). When the electromagnetic wave is selectively supplied to the radiators 51(1), 51(2), . . . 51(5), the electromagnetic wave can be radiated in a direction corresponding to a position of that radiator, thereby enabling switching of the beam direction.

This realization of the multi-beam switching can be also applied to the above-described electromagnetic leaky-wave antenna 40.

(Fourth Embodiment)

Figure 21:
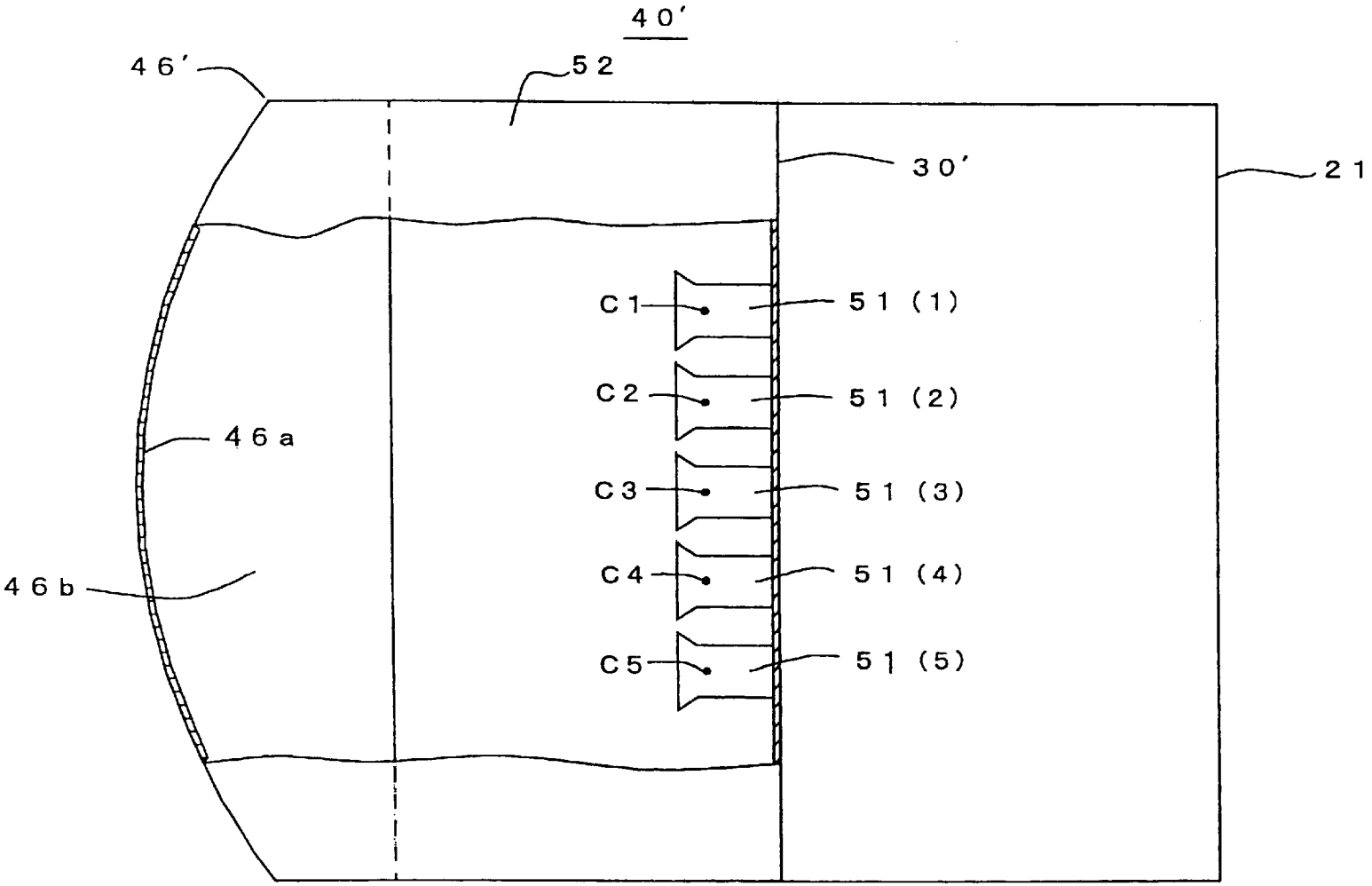
FIG. 21 is a front view for illustrating a structure when the feed and the wave-front conversion section shown in FIG. 11 are modified as a dielectric leaky-wave antenna according to a fourth embodiment of the present invention.

FIG. 21 is a front view for illustrating a structure when the feed and the wave-front conversion section in FIG. 11 are modified as a dielectric leaky-wave antenna according to a fourth embodiment of the present invention.

In this case, it is good enough that the reflecting wall 46*a* of the wave-front conversion section 46 is formed as a parabola type wall and the phase centers C1, C2, . . . C5 of a plurality of radiators 51(1), 51(2), 51(5) of the feed 30' are arranged on the focal plane of the wave-front conversion section 46 or in the vicinity of the same, as in the dielectric leaky-wave antenna 40' shown in FIG. 21.

It is to be noted that, in the above-described dielectric leaky-wave antennas 20' and 40', the tapered matching section 27 is formed at the end of the wave-front conversion section 26' or the end of the dielectric slab 23.

On the contrary, as described above, the matching section 27' or the matching dielectric 41 having a different dielectric constant may be used in place of the matching section 27.

Further, as to the dielectric leaky-wave antenna 20' and 40', the matching section which protrudes from the inner side of the opening portion of the cover 52 toward the ground plane 21 side may be provided as similar to the matching section 46*c* provided at the opening portion of the guide section 46.

Furthermore, the metallic strip 34, the slot 37 or a pair of metallic slits 34*a* and 34*b* may be used instead of the metallic strip 24 as the perturbation, or the metallic strips 24 and 25 or the slots 37 and 39 may be used as a pair of perturbations.

In the case of the antenna formed to deal with multiple beams, the electromagnetic wave must be selectively supplied to the respective radiators 51(1), 51(2), . . . 51(5).

Figure 22:
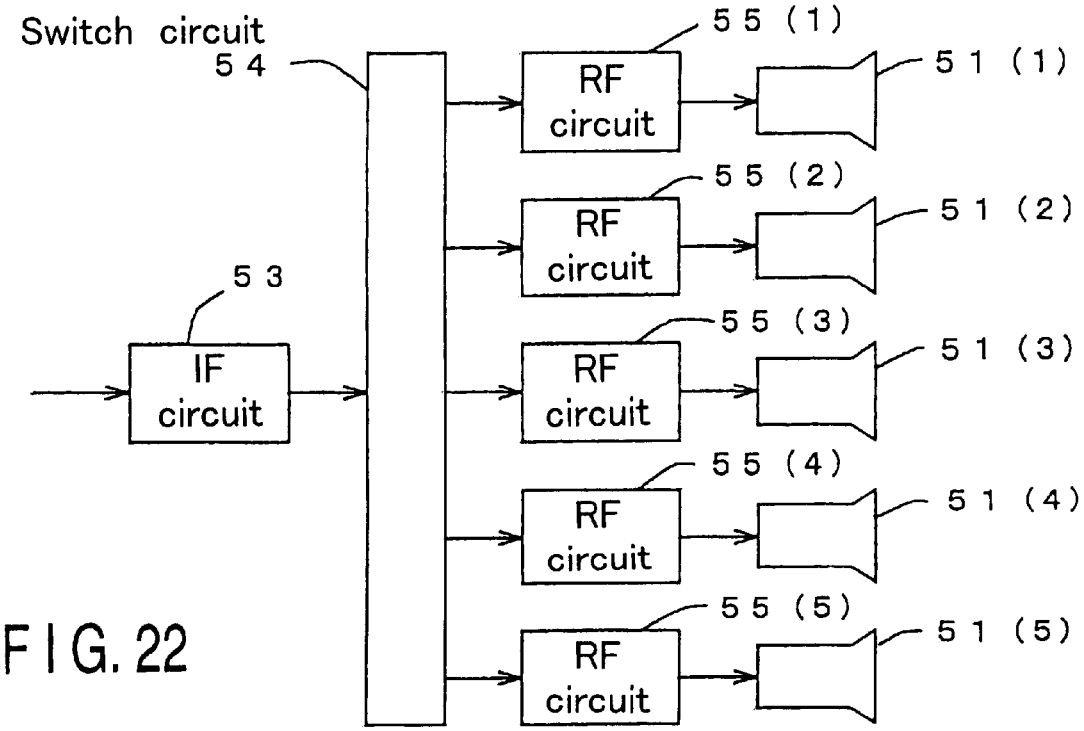
FIG. 22 is a block diagram showing an example of a feeder circuit applied to the third and fourth embodiments according to the present invention.

FIG. 22 is a block diagram showing an example of a feeder circuit applied to the third and fourth embodiments of the present invention.

Figure 23:
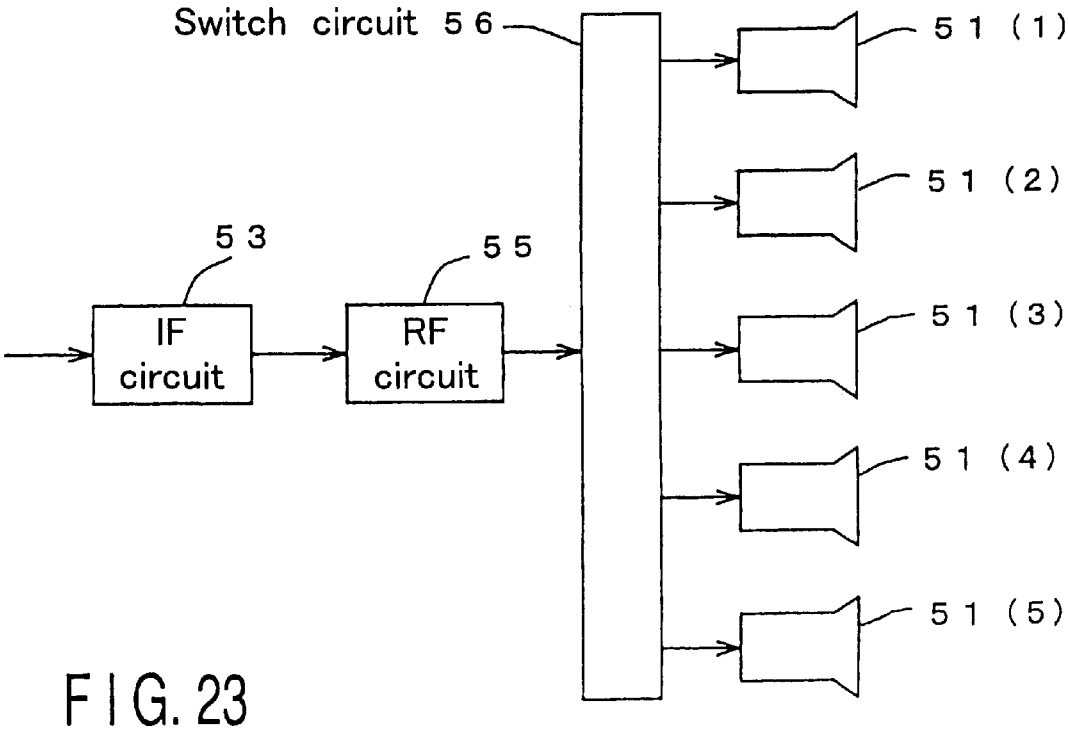
FIG. 23 is a block diagram showing an example of the feeder circuit applied to the third and fourth embodiments according to the present invention.

FIG. 23 is a block diagram showing another example of the feeder circuit applied to the third and fourth embodiments of the present invention.

That is, FIGS. 22 and 23 show examples of the feeder circuit for the antenna formed so as to deal with multiple beams.

The feeder circuit shown in FIG. 22 selectively inputs by a switch circuit 54 an IF signal outputted from an IF circuit 53 to any of a plurality of RF circuits (including frequency conversion circuits) 55(1), 55(2), . . . 55(5) which are provided in accordance with the respective radiators 51(1), 51(2), . . . 51(5).

On the other hand, the feeder circuit shown in FIG. 23 converts the IF signal outputted from the IF circuit 53 into an RF signal by the RF circuit, and selectively inputs this RF signal to any of the radiators 51(1), 51(2), . . . 51(5) by the switch circuit 56.

Incidentally, in view of the performance and packaging, the feeder circuit shown in FIG. 22 which carries out switching of the IF signal is more advantageous. When it comes to the circuit scale, the feeder circuit shown in FIG. 23 in which a pair of RF circuits can suffice is more advantageous. Therefore, selection of either feeder circuit can be decided in accordance with each purpose.

Moreover, although not shown, each radiator 51 is coupled to the RF circuit 55 or the switch circuit 56 through a coupling slot or a coupling probe and the like.

As described above, the dielectric leaky-wave antenna (1) according to the present invention is constituted by the ground plane, the dielectric slab which is laid on one surface of the ground plane and forms the transmission guide for transmitting the electromagnetic wave from one end side to the other end side along the surface between the dielectric slab and the ground plane, the perturbations which are loaded on the surface of the dielectric slab along the electromagnetic wave transmission direction of the transmission guide at predetermined intervals, and the feed for supplying the electromagnetic wave to one end side of the transmission guide, thereby readily radiating the linearly polarized electromagnetic wave with a simple structure.

Further, according to the dielectric leaky-wave antenna (2) of the present invention, in the dielectric leaky-wave antenna (1), the perturbation has a length which is substantially equal to the width of the dielectric slab and is constituted by a metallic strip or a slot which is orthogonal to the electromagnetic wave transmission direction of the transmission guide, thereby easily radiating the linearly polarized electromagnetic wave with a simple structure.

Furthermore, according to the dielectric leaky-wave antenna (3) of the present invention, in the dielectric leaky-wave antenna (1), since the perturbation is constituted by a metallic strip or a slot having an angle of 45 degrees relative to the electromagnetic wave transmission direction of the transmission guide, the 45-degree linearly polarized electromagnetic wave can be readily radiated with a simple structure, which is preferable as an antenna for a radar mounted in an automobile.

Moreover, according to the dielectric leaky-wave antenna (4) of the present invention, in the dielectric leaky-wave antenna (2) or (3), since a pair of perturbations arranged in parallel in such a manner that an interval along the electromagnetic wave transmission direction of the transmission guide becomes substantially ¼ of a wavelength of the electromagnetic wave in the transmission guide are loaded along the electromagnetic wave transmission direction of one transmission guide at the predetermined intervals, reflection in the transmission guide caused due to the perturbations can be canceled out, thereby reducing disturbance of the characteristic.

In addition, according to the dielectric leaky-wave antenna (5) of the present invention, in the dielectric leaky-wave antenna (1), since the perturbation is formed by a pair of metallic strips or a pair of slots which form an angle of 90 degrees each other and each of which has an angle of 45 degrees relative to the electromagnetic wave transmission direction of the transmission guide, the polarization state can be changed by varying an interval between the pair of metallic strips or the pair of slots.

Additionally, according to the dielectric leaky-wave antenna (6) of the present invention, in the dielectric leaky-wave antenna (5), since the interval of the pair of metallic strips or the pair of slots is set to approximately ¼ or ½ of the wavelength in the transmission guide, the horizontally polarized or circularly polarized electromagnetic wave can be easily radiated with a simple structure.

Further, according to the dielectric leaky-wave antenna (7) of the present invention, in the dielectric leaky-wave antenna (5), since the feed is constituted so as to radiate the cylindrical wave and the wave-front conversion section which converts the cylindrical wave radiated from the feed into a plane wave and leads it to the transmission guide is provided to one end side of the dielectric slab, the electromagnetic wave which is in phase can be supplied to the transmission guide formed by the dielectric slab.

In addition, according to the dielectric leaky-wave antenna (8) of the present invention, in the dielectric leaky-wave antenna (7), since the wave-front conversion section is formed by extending the dielectric slab to the feed side, the structure is simplified, and the electromagnetic wave subjected to wave-front conversion can be directly led to the transmission guide, which is efficient.

Furthermore, according to the dielectric leaky-wave antenna (9) of the present invention, in the dielectric leaky-wave antenna (8), the feed is formed so as to transmit the electromagnetic wave inputted from one end side thereof to one end side of the dielectric slab along the ground plane and radiate the electromagnetic wave from the aperture portion on the other side formed so as to surround the edge portion on one end side of the dielectric slab, and the matching section which protrudes toward the ground plane is provided to the aperture portion on the other end side of the feed in such a manner that a gap between the matching section and the surface of the wave-front conversion section becomes gradually or continuously small toward the wave-front conversion section in order to match the feed and the wave-front conversion section. Therefore, the taper processing and the like of the dielectric slab is no longer necessary, thereby matching between the feed and the wave-front conversion section with a simple structure.

Moreover, according to the dielectric leaky-wave antenna (10) of the present invention, in the dielectric leaky-wave antenna (8), since the matching section for matching the feed and the wave-front conversion section and leading the electromagnetic wave supplied from the feed to the wave-front conversion section is provided to the front end of the wave-front conversion section, the electromagnetic wave from the feed can be efficiently led to the wave-front conversion section.

In addition, in the dielectric leaky-wave antenna (11) of the present invention, in the dielectric leaky-wave antenna (7), the wave-front conversion section has the reflecting wall for converting the cylindrical wave into the plane wave and one half portion of the reflecting wall is arranged so as to be directed to one end side of the dielectric slab. The feed is arranged with its radiation aperture being directed to the other half portion of the reflecting wall of the wave-front conversion section so as to radiate the electromagnetic wave to the other half portion on the opposite side to the dielectric slab with the ground plane being sandwiched between the feed and the dielectric slab. Therefore, the length of the entire antenna can be shortened.

Additionally, according to the dielectric leaky-wave antenna (12) of the present invention, in the dielectric leaky-wave antenna (11), since the matching section for matching the wave-front conversion section with the transmission guide of the dielectric slab is provided to one end side of the dielectric slab, the electromagnetic wave can be efficiently led from the wave-front conversion section to the dielectric slab.

Further, according to the dielectric leaky-wave antenna (13) of the present invention, in the dielectric leaky-wave antenna (10), the matching section is formed into a tapered shape so that the thickness is reduced toward the input side of the electromagnetic wave, thereby efficiently leading the electromagnetic wave with a simple structure.

Furthermore, according to the dielectric leaky-wave antenna (14) of the present invention, in the dielectric leaky-wave antenna (10) or (12), since the matching section is constituted by the dielectric having a dielectric constant different from that of the dielectric slab, fracture or damage to the dielectric slab caused due to the taper processing can be prevented from occurring.

Moreover, according to the dielectric leaky-wave antenna (15) of the present invention, in the dielectric leaky-wave antenna (12), the wave-front conversion section is formed so as to transmit the electromagnetic wave reflected by the reflecting wall to one end side of the dielectric slab along the ground plane and radiate the electromagnetic wave from the aperture portion formed so as to surround the edge portion on one end side of the dielectric slab, and the matching section which protrudes toward the ground plane side is provided to the aperture portion of the wave-front conversion section in such a manner that the gap between the matching section and the surface of the dielectric slab gradually or continuously becomes small toward the dielectric slab side in order to match the wave-front conversion section with the transmission guide of the dielectric slab. Therefore, the taper processing and the like of the dielectric slab is no longer necessary, thereby attaining matching between the wave-front conversion section and the transmission guide of the dielectric slab with a simple structure.

In addition, according to the dielectric leaky-wave antenna (16) of the present invention, in the dielectric leaky-wave antenna (11), the feed has a plurality of radiators having different radiation center positions, and the wave-front conversion section converts the cylindrical wave radiated from each radiator into the plane wave whose wave front is inclined at an angle corresponding to the phase center position of that radiator and supplies the obtained wave to the transmission guide. Therefore, selectively supplying the electromagnetic wave to the radiator can change the beam direction, thereby realizing the beam switching.

Additionally, in such an invention, in order to maintain the antenna efficiency high, by providing a "dielectric leaky-wave antenna having a single-layer structure" which is of a so-called image guide type in which the dielectric slab is laid on the ground plane, the thickness of the dielectric slab can be ½ of the thickness obtained when the above-described "dielectric leaky-wave antenna (double-layer structure)" is applied to a quasi-millimeter wave zone. Based on this important knowledge, since the thickness of the dielectric slab can be approximately 0.6 to 0.8 mm as compared with the prior art, the alumina slab having a regular thickness as the standard size which is generally used as such a dielectric slab can be used as it is, thereby reducing the material cost.

Further, by providing such a "dielectric leaky-wave antenna having a single-layer structure", the conductor loss is increased on the whole as compared with the case where an air layer is provided as in the above-described "dielectric leaky-wave antenna (double-layer structure)". However, since the conductor loss itself is in proportion to the square root of the frequency, its influence can be relatively small in the quasi-millimeter wave zone.

Furthermore, in such a "dielectric leaky-wave antenna having a single-layer structure", the antenna structure such as provision of metallic strip rows which are uniform in the transverse direction on the dielectric slab surface or provision of the reflection suppression strip on the same surface can be also developed commonly with the above-described "dielectric leaky-wave antenna (double-layer structure)".

Therefore, as described above in detail, according to the present invention, the dielectric leaky-wave antenna having a single-layer structure which is effective for realizing the highly efficient low-cost antenna can be provided with respect to communication in the quasi-millimeter wave zone such as 22 GHz, 26 GHz, 38 GHz . . . in particular, for example, wireless access, an indoor wireless LAN, or applications of a low frequency domain of the millimeter wave.

What is claimed is:

1. A dielectric leaky-wave antenna comprising:

a ground plane;

a dielectric slab on one surface of said ground plane, which forms a transmission guide for transmitting an electromagnetic wave from one end side to another end side along a surface of said dielectric slab;

perturbations on the surface of said dielectric slab along the electromagnetic wave transmission direction of said transmission guide at predetermined intervals which leak the electromagnetic wave from the surface of said dielectric slab; and a feed which supplies the electromagnetic wave to one end side of said transmission guide, wherein each of said perturbations comprise a metallic strip or a slot which has an angle of 45 degrees relative to the electromagnetic wave transmission direction of said transmission guide.

2. The dielectric leaky-wave antenna according to claim 1, wherein said perturbations are constituted by a pair of metallic strips or a pair of slots which form an angle of 90 degrees and each of which has an angle of 45 degrees relative to the electromagnetic wave transmission direction of said transmission guide.

3. The dielectric leaky-wave antenna according to claim 2, wherein an interval between said metallic strips forming a pair or an interval between said slots is set to approximately ¼ or ½ of a wavelength of the electromagnetic wave in said transmission guide.

4. The dielectric leaky-wave antenna according to claim 1, wherein said feed is constituted so as to radiate a cylindrical wave, and a wave-front conversion section for converting the cylindrical wave radiated from said feed into a plane wave and leading it to said transmission guide is provided on one end side of said dielectric slab.

5. The dielectric leaky-wave antenna according to claim 4, wherein said wave-front conversion section has a reflecting wall for converting the cylindrical wave into the plane wave, one half portion of said reflecting wall is arranged so as to be directed to one end side of said dielectric slab, and said feed is arranged with its radiation aperture directed so as to radiate the electromagnetic wave to the other half portion of said reflecting wall of said wave-front conversion section on the opposite side to said dielectric slab with said ground plane between said feed and said dielectric slab.

6. The dielectric leaky-wave antenna according to claim 5, wherein a matching section for attaining matching between said wave-front conversion section and said transmission guide of said dielectric slab is provided on one end side of said dielectric slab.

7. The dielectric leaky-wave antenna according to claim 6, wherein said wave-front conversion section is formed so as to transmit the electromagnetic wave reflected by said reflecting wall to one end side of said dielectric slab along said ground plane and radiate the electromagnetic wave from an aperture portion formed so as to surround an edge portion on one end side of said dielectric slab, and a matching section which protrudes toward said ground plane side is provided to said aperture portion of said wave-front conversion section in such a manner that a gap between itself and the surface of said dielectric slab gradually or continuously becomes small toward said dielectric slab side in order to attain matching between said wave-front conversion section and said transmission guide of said dielectric slab.

8. The dielectric leaky-wave antenna according to claim 6, wherein said matching section is formed into a tapered shape so that its thickness is reduced toward an input side of the electromagnetic wave.

9. The dielectric leaky-wave antenna according to claim 6, wherein said matching section is constituted by a dielectric having a dielectric constant different from that of said dielectric slab.

10. The dielectric leaky-wave antenna according to claim 4, wherein said feed has a plurality of radiators having different phase center positions, and wherein said wave-front conversion section converts the cylindrical wave radiated from each of said radiators into a plane wave whose wave front is inclined at an angle corresponding to the phase center position of that radiator and supplies it to said transmission guide.

11. The dielectric leaky-wave antenna according to claim 4, wherein said wave-front conversion section is formed by extending said dielectric slab to said feed side.

12. The dielectric leaky-wave antenna according to claim 11, wherein said feed is formed so as to transmit the electromagnetic wave inputted from one end side to one end side of said dielectric slab along said ground plane and radiate the electromagnetic wave from an aperture portion on the other end side formed so as to surround an edge portion on one end side of said dielectric slab, and a matching section which protrudes toward said ground plane is provided to an aperture portion on the other end side of said feed in such a manner that a gap between itself and the surface of said wave-front conversion section gradually or continuously becomes small toward said wave-front conversion section side in order to attain matching between said feed and said wave-front conversion section.

13. The dielectric leaky-wave antenna according to claim 11, wherein a matching section for attaining matching between said feed and said wave-front conversion section and leading the electromagnetic wave supplied from said feed to said wave-front conversion section is provided at a front end of said wave-front conversion section.

14. The dielectric leaky-wave antenna according to claim 13, wherein said matching section is formed into a tapered shape so that its thickness is reduced toward an input side of the electromagnetic wave.

15. The dielectric leaky-wave antenna according to claim 13, wherein said matching section is constituted by a dielectric having a dielectric constant different from that of said dielectric slab.

16. The dielectric leaky-wave antenna according to claim 1, wherein a pair of said perturbations arranged in parallel to each other in such a manner that an interval along the electromagnetic wave transmission direction of said transmission guide becomes substantially ¼ of a wavelength of the electromagnetic wave in said transmission guide are loaded along the electromagnetic wave transmission direction of said transmission guide at said predetermined interval.

17. A dielectric leaky-wave antenna comprising:

a ground plane;

a dielectric slab on one surface of said ground plane, which forms a transmission guide for transmitting an electromagnetic wave from one end side to another end side along a surface of said dielectric slab;

perturbations on the surface of said dielectric slab along the electromagnetic wave transmission direction of said transmission guide at predetermined intervals which leak the electromagnetic wave from the surface of said dielectric slab; and a feed which supplies the electromagnetic wave to one end side of said transmission guide, wherein said perturbations each has a length substantially equal to a width of said dielectric slab and comprise a metallic strip or a slot orthogonal to the electromagnetic wave transmission direction of said transmission guide, and wherein a pair of said perturbations are arranged in parallel to each other such that an interval along the electromagnetic wave transmission direction of said transmission guide becomes substantially ¼ of a wavelength of the electromagnetic wave in said transmission guide, said pair of perturbations being disposed along the electromagnetic wave transmission direction of said transmission guide at said predetermined interval.

18. The dielectric leaky-wave antenna according to claim 17, wherein said perturbations comprise a pair of metallic strips or a pair of slots which form a 90° angle and each of which has a 45° angle relative to the electromagnetic wave transmission direction of said transmission guide.

19. The dielectric leaky-wave antenna according to claim 18, wherein an interval between said metallic strips forming a pair or an interval between said slots is set to approximately ¼ or ½ of a wavelength of the electromagnetic wave in said transmission guide.

20. The dielectric leaky-wave antenna according to claim 17, wherein said feed is constituted so as to radiate a cylindrical wave, and a wave-front conversion section which converts the cylindrical wave radiated from said feed into a plane wave and leading it to said transmission guide is provided on one end side of said dielectric slab.

21. The dielectric leaky-wave antenna according to claim 20, wherein said wave-front conversion section is formed by extending said dielectric slab to said feed side.

22. The dielectric leaky-wave antenna according to claim 21, wherein said feed transmits the electromagnetic wave input from one end side to another end side of said dielectric slab along said ground plane, and radiates the electromagnetic wave from an aperture portion on the other end side so as to surround an edge portion on one end side of said dielectric slab, and a matching section which protrudes toward said ground plane is provided to an aperture portion on the other end side of said feed in such a manner that a gap between itself and the surface of said wave-front conversion section gradually or continuously becomes small toward said wave-front conversion section side in order to attain matching between said feed and said wave-front conversion section.

23. The dielectric leaky-wave antenna according to claim 21, further comprising a matching section for attaining matching between said feed and said wave-front conversion section and leading the electromagnetic wave supplied from said feed to said wave-front conversion section provided at a front end of said wave-front conversion section.

24. The dielectric leaky-wave antenna according to claim 23, wherein said matching section is tapered so that its thickness is reduced toward an input side of the electromagnetic wave.

25. The dielectric leaky-wave antenna according to claim 23, wherein said matching section comprises a dielectric having a dielectric constant different from that of said dielectric slab.

26. The dielectric leaky-wave antenna according to claim 20, wherein said wave-front conversion section includes a reflecting wall for converting the cylindrical wave into the plane wave, one half portion of said reflecting wall is arranged so as to be directed to one end side of said dielectric slab, and said feed is arranged with its radiation aperture directed so as to radiate the electromagnetic wave to the other half portion of said reflecting wall of said wave-front conversion section on the opposite side to said dielectric slab with said ground plane between said feed and said dielectric slab.

27. The dielectric leaky-wave antenna according to claim 26, wherein a matching section for attaining matching between said wave-front conversion section and said transmission guide of said dielectric slab is on one end side of said dielectric slab.

28. The dielectric leaky-wave antenna according to claim 27, wherein said wave-front conversion section transmits the electromagnetic wave reflected by said reflecting wall to one end side of said dielectric slab along said ground plane and radiates the electromagnetic wave from an aperture portion formed so as to surround an edge portion on one end side of said dielectric slab, and a matching section which protrudes toward said ground plane side is provided to said aperture portion of said wave-front conversion section such that a gap between itself and the surface of said dielectric slab gradually or continuously becomes small toward said dielectric slab side in order to attain matching between said wave-front conversion section and said transmission guide of said dielectric slab.

29. The dielectric leaky-wave antenna according to claim 27, wherein said matching section is tapered so that its thickness is reduced toward an input side of the electromagnetic wave.

30. The dielectric leaky-wave antenna according to claim 27, wherein said matching section is constituted by a dielectric having a dielectric constant different from that of said dielectric slab.

31. The dielectric leaky-wave antenna according to claim 20, wherein said feed has a plurality of radiators having different phase center positions, and wherein said wave-front conversion section converts the cylindrical wave radiated from each of said radiators into a plane wave whose wave front is inclined at an angle corresponding to the phase center position of that radiator and supplies it to said transmission guide.

32. A dielectric leaky-wave antenna comprising:

a ground plane;

a dielectric slab on one surface of said ground plane, which forms a transmission guide for transmitting an electromagnetic wave from one end side to the other end side along a surface of said dielectric slab;

perturbations on the surface of said dielectric slab along the electromagnetic wave transmission direction of said transmission guide at predetermined intervals which leak the electromagnetic wave from the surface of said dielectric slab; and a feed which supplies the electromagnetic wave to one end side of said transmission guide, wherein said perturbations are constituted by a metallic strip or a slot which has a 45° angle relative to the electromagnetic wave transmission direction of said transmission guide, and wherein a pair of said perturbations are arranged in parallel to each other such that an interval along the electromagnetic wave transmission direction of said transmission guide becomes substantially ¼ of a wavelength of the electromagnetic wave in said transmission guide, said pair of perturbations being disposed along the electromagnetic wave transmission direction of said transmission guide at said predetermined interval.

33. The dielectric leaky-wave antenna according to claim 32, wherein said perturbations comprise a pair of metallic strips or a pair of slots which form a 90° angle, and each of which has a 45° angle relative to the electromagnetic wave transmission direction of said transmission guide.

34. The dielectric leaky-wave antenna according to claim 33, wherein an interval between said metallic strips forming a pair or an interval between said slots is set to approximately ¼ or ½ of a wavelength of the electromagnetic wave in said transmission guide.

35. The dielectric leaky-wave antenna according to claim 32, wherein said feed is constituted so as to radiate a cylindrical wave, and a wave-front conversion section which converts the cylindrical wave radiated from said feed into a plane wave and leading it to said transmission guide is provided on one end side of said dielectric slab.

36. The dielectric leaky-wave antenna according to claim 35, wherein said wave-front conversion section is formed by extending said dielectric slab to said feed side.

37. The dielectric leaky-wave antenna according to claim 36, wherein said feed transmits the electromagnetic wave input from one end side to another end side of said dielectric slab along said ground plane, and radiates the electromagnetic wave from an aperture portion on the other end side so as to surround an edge portion on one end side of said dielectric slab, and a matching section which protrudes toward said ground plane is provided to an aperture portion on the other end side of said feed in such a manner that a gap between itself and the surface of said wave-front conversion section gradually or continuously becomes small toward said wave-front conversion section side in order to attain matching between said feed and said wave-front conversion section.

38. The dielectric leaky-wave antenna according to claim 36, further comprising a matching section for attaining matching between said feed and said wave-front conversion section and leading the electromagnetic wave supplied from said feed to said wave-front conversion section provided at a front end of said wave-front conversion section.

39. The dielectric leaky-wave antenna according to claim 38, wherein said matching section is tapered so that its thickness is reduced toward an input side of the electromagnetic wave.

40. The dielectric leaky-wave antenna according to claim 38, wherein said matching section comprise a dielectric having a dielectric constant different from that of said dielectric slab.

41. The dielectric leaky-wave antenna according to claim 35, wherein said wave-front conversion section includes a reflecting wall which converts the cylindrical wave into the plane wave, one half portion of said reflecting wall is directed to one end side of said dielectric slab, and said feed is arranged with its radiation aperture directed so as to radiate the electromagnetic wave to the other half portion of said reflecting wall of said wave-front conversion section on the opposite side to said dielectric slab with said ground plane between said feed and said dielectric slab.

42. The dielectric leaky-wave antenna according to claim 41, wherein a matching section for attaining matching between said wave-front conversion section and said transmission guide of said dielectric slab is on one end side of said dielectric slab.

43. The dielectric leaky-wave antenna according to claim 42, wherein said wave-front conversion section transmits the electromagnetic wave reflected by said reflecting wall to one end side of said dielectric slab along said ground plane and radiates the electromagnetic wave from an aperture portion formed so as to surround an edge portion on one end side of said dielectric slab, and a matching section which protrudes toward said ground plane side is provided to said aperture portion of said wave-front conversion section such that a gap between itself and the surface of said dielectric slab gradually or continuously becomes small toward said dielectric slab side in order to attain matching between said wave-front conversion section and said transmission guide of said dielectric slab.

44. The dielectric leaky-wave antenna according to claim 42, wherein said matching section is tapered so that its thickness is reduced toward an input side of the electromagnetic wave.

45. The dielectric leaky-wave antenna according to claim 42, wherein said matching section is constituted by a dielectric having a dielectric constant different from that of said dielectric slab.

46. The dielectric leaky-wave antenna according to claim 35, wherein said feed has a plurality of radiators having different phase center positions, and wherein said wave-front conversion section converts the cylindrical wave radiated from each of said radiators into a plane wave whose wave front is inclined at an angle corresponding to the phase center position of that radiator and supplies it to said transmission guide.

* * * * *